United States Patent [19]

Hara

[11] Patent Number: 4,910,974

[45] Date of Patent: Mar. 27, 1990

[54] AUTOMATIC ICE MAKING MACHINE

[75] Inventor: Yasuo Hara, Toyoake, Japan

[73] Assignee: Hoshizaki Electric Company Limited, Toyoake, Japan

[21] Appl. No.: 302,472

[22] Filed: Jan. 26, 1989

[30] Foreign Application Priority Data

Jan. 29, 1988 [JP] Japan ..... 63-19858
Nov. 22, 1988 [JP] Japan ..... 63-295712

[51] Int. Cl.[4] ..... F25C 1/12
[52] U.S. Cl. ..... 62/347; 62/352
[58] Field of Search ..... 62/347, 348, 352, 73, 62/74

[56] References Cited

U.S. PATENT DOCUMENTS

| | | | |
|---|---|---|---|
| 2,542,892 | 2/1951 | Bayston | 62/347 |
| 2,613,506 | 10/1952 | Cook | 62/352 X |
| 2,726,514 | 12/1955 | Capehart et al. | 62/352 X |
| 3,009,336 | 11/1961 | Bayston et al. | 62/347 X |
| 3,045,443 | 7/1962 | McGrath et al. | 62/347 X |

*Primary Examiner*—William E. Tapolcai
*Attorney, Agent, or Firm*—Koda & Androlia

[57] ABSTRACT

Dislosed is an automatic ice making machine having a constitution in which a water to be frozen stored within a water tank is fed under pressure to a distributor pipe via a pump and injected through injection holes formed along said distributor pipe into a freezing chamber cooled by an evaporator connected to a freezing system, to form ice cakes within said freezing chamber, while part of the freezing water which is not frozen within said freezing chamber is fed back to said water tank for recirculation, characterized in that said ice making chamber consists of a first freezing chamber having formed thereon a multiplicity of downwardly opening first freezing cells of a predetermined recessed shape, with said evaporator disposed on its rear surface; and a second freezing chamber having formed thereon a multiplicity of second freezing cells of a predetermined recessed shape, which is disposed relative to said first freezing chamber such that the former may be moved closer to or spaced from the latter, wherein said second freezing cells close the corresponding first freezing cells from downside, respectively, to define ice forming spaces of a spherical or polyhedral shape therebetween during the freezing operation.

8 Claims, 22 Drawing Sheets

10
11
13
13
13
13
15
15
15
15
15
15
15
12
12a
12a
12a 12a
12a
12a (a)

(b)

(c)

(d)

AUTOMATIC ICE MAKING MACHINE

FIELD OF THE INVENTION

This invention relates to an automatic ice making machine, more particularly to an automatic ice making machine which can continuously make ice cakes such as of spherical shape (ball) or polyhedral shape (diamond-cut cake), as well as the generally known conventional square ice cakes such as of regular hexahedral shape (cube), in large quantities.

BACKGROUND OF THE INVENTION

In various fields of industries, automatic ice making machines which make ice cubes having a regular hexahedral shape, ice plates having a predetermined thickness or ice cakes or blocks of other shapes are suitably utilized depending on the purpose. For example, as the above ice making machine for making ice cubes, known are:

(1) a so-called closed cell system ice making machine, in which a plurality of cubic freezing cells defined to open downward in a freezing chamber is closed with a water tray which is descendable, such that the water to be frozen may be injected into each freezing cell from the water tray to form ice cubes gradually in the freezing cells; and (2) a so-called open cell system ice making machine, in which a water to be frozen is directly fed into a plurality of freezing cells which opens downward without using a water tray to form ice cubes in the freezing cells.

On the other hand, as the ice making machine for making ice plates continuously, widely used are those of flow-down system in which a freezing plate equipped with an evaporator connected to a freezing system is disposed to form a slant plane, and a water to be frozen is supplied to flow over the upper or lower surface of this freezing plate to form an ice plate over the surface of the freezing plate. Further, there is practically employed an ice making system for obtaining ice flakes, in which water is allowed to flow down along the internal wall surface of a freezing cylinder to form an ice layer, which is scratched with a cutting blade of a rotary auger, or for obtaining granular crushed ice by crushing the ice plate obtained from the aforementioned ice making machine.

As described above, the ice which can be made by any of the automatic ice making machines according to the conventional methods have been limited to cubic ice cakes, ice plates, ice flakes and crushed ice. Among these types of ice, those which have a certain shape and can be used as such directly, for cooling a glass of drink or as a cooling bed for various food materials, are only limited to the ice cubes mentioned above (although ice plates may be made to have a fixed shape, they are usually unusable as such with their original sizes). Therefore, in coffee shops, restaurants and other food service shops, earnest efforts are made recently to be distinguished from and to emulate others which offer the same type of service. As a part of such efforts, for example, there is a tendency in some shops to use ice balls instead of ice cubes which have conventionally been used widely, to treat customers with something new or a change.

As a means for making such ice balls, as shown, for example, in Japanese Provisional Utility Model Publication No. 60177/1983, there is known an ice tray composed of a tray in which a suitable number of concaves having an arbitrary shape have been formed and a removable cover having concaves corresponding to the recesses of the tray. In this ice tray, spherical ice cakes are obtained by introducing water into the spherical spaces defined by these concaves and placing the ice tray containing the water in the freezer of a refrigerator for a predetermined time to allow the water contained in the spherical spaces to be frozen. Further, some attempts are made, for example, to introduce water into a bag made of an elastic film such as a rubber sheet, which is placed in the freezer or immersed in an anti-freezing solution as a cold medium to form ice balls; or to cut an ice block with a cutter into ice balls.

However, the methods of making ice balls by use of the means described above cannot afford a large amount of ice balls continuously, but require troublesome handling and time inefficiently, so that they cannot be employed for business purposes. Moreover, since ice cakes are made by causing the water to freeze statically in a freezer or in an antifreezing solution in the above methods, the ice cakes obtained are opacified with the very small amount of air contained in the water. Therefore, the above methods involve disadvantage that no clear and transparent ice cakes can be obtained, resulting in reduced commercial value. Thus, under the present circumstances when there is an increasing demand for such machines, no such machine which can make a large amount of uniform and transparent ice balls or polyhedral ice cakes continuously has yet been utilized practically.

OBJECT OF THE INVENTION

This invention has been proposed in view of the above problems inherent in the prior art which should be solved properly, and is directed to provide an automatic ice making machine having a novel constitution which is simple and can make uniform and transparent ice balls or polyhedral ice cakes continuously in large amounts.

SUMMARY OF THE INVENTION

For the purpose of overcoming the above objects and obtaining the intended objects suitably, this invention provides an automatic ice making machine, having a constitution in which a water to be frozen stored within a water tank is fed under pressure to a distributor pipe via a pump and injected through injection holes formed along said distributor pipe into a freezing chamber cooled by an evaporator connected to a freezing system to form ice cakes within said freezing chamber, while part of the freezing water which is not frozen within said freezing chamber is fed back to said water tank for recirculation, characterized in that said ice making chamber consists of a first freezing chamber having formed thereon a multiplicity of downwardly opening first freezing cells of a predetermined recessed shape, with said evaporator disposed on its rear surface; and a second freezing chamber having formed thereon a multiplicity of second freezing cells of a predetermined recessed shape, which is disposed relative to said first freezing chamber such that the former may be moved closer to or spaced from the latter, wherein said second freezing cells close the corresponding first freezing cells from downside, respectively, to define ice forming spaces of a spherical or polyhedral shape therebetween during the freezing operation.

As will be described in detail, according to the automatic ice making machines in the first to third embodiments of this invention, ice balls with a predetermined diameter may be continuously produced in large quantities, which allows them to be used in various industrial applications. Although illustrated embodiments (to be described later) refer to a case where ice balls are being made, if the interior configurations of the first and second freezing chambers are changed, they may also suitably be used for mass production of polyhedral ice cakes as illustrated in FIG. 19 (*b*). Because of the high density and extreme hardness of the ice balls to be made by the present machine, they may be used, for exmple, as golf balls as well as for the restaurant or coffee shop application. In the former case, when they are used in a golf practice range, the hit ice balls finally melt into water, which may eliminate the trouble of collecting the balls.

BRIEF DESCRIPTION OF THE DRAWINGS

FIG. 1 shows an initial state in which the ice making operation is started by closing the first freezing chamber with the second freezing chamber, and FIG. 2 shows a state in which the ice making process is in progress and hollow ice balls are being formed within the first and second freezing cells. FIG. 3 shows a state where the ice making process is approaching the final stage, in which substantially solid ice balls are being formed within the first and second freezing cells and the level of the water for ice making within the tank has dropped. FIG. 4 shows a state where the ice making operation has substantially completed to form solid ice balls within the first and second freezing cells. FIG. 5 shows a state in which the ice making operation has completed to open the water supply valve and the water which has overflown from a dam due to the rise of water level at a water reservoir flows down along the rear surface of an ice guide plate, to be discharged from a drain tray to the outside of the machine. FIG. 6 shows a state in which an actuator motor is energized to tilt and open the second freezing chamber clockwise, thereby a catch disposed to a water tray is abutted against an inversion lever. FIG. 7 shows a state in which the ice guide plate has fallen over the upper surface of the second freezing chamber to block each of the second freezing cells. FIG. 8 shows a state in which the ice balls are dropping from the second freezing chamber to slide down along the ice guide plate which locates immediately below the second freezing chamber in a tilted posture. FIG. 9 shows a state in which the ice guide plate is also beginning to return to the original position as soon as the ice balls are removed, and the second freezing chamber starts to turn counterclockwise to its initial position. FIG. 13 is a longitudinal cross-sectional view illustrating the schematic construction of the ice making machine according to the second embodiment. FIG. 14 is a schematic perspective view illustrating the second freezing chamber, in an open posture, of the ice making machine shown in FIG. 13. FIG. 15 is a circuit diagram illustrating one example of ice making control circuit which runs and controls the apparatus of the second embodiment. FIG. 16 is a longitudinal cross-sectional view illustrating the schematic construction of the ice making mechanism according to the third embodiment. FIG. 17 (*a*) to (*d*) each are an explanatory view sequentially illustrating the states in which the second freezing chamber is turned with a great angle to be separated from the first freezing chamber and whereby the ice balls are discharged from the second freezing chamber toward an ice reservoir. FIG. 18 is a circuit diagram illustrating one example of control circuit for the freezing system which runs and controls the apparatus according to the third embodiment. FIG. 19 (*b*) is an explanatory view of a polyhedral ice cake. FIG. 19 (*c*) is an explanatory view of a hollow spherical ice cake.

DETAILED DESCRIPTION OF THE INVENTION

Figure 19:
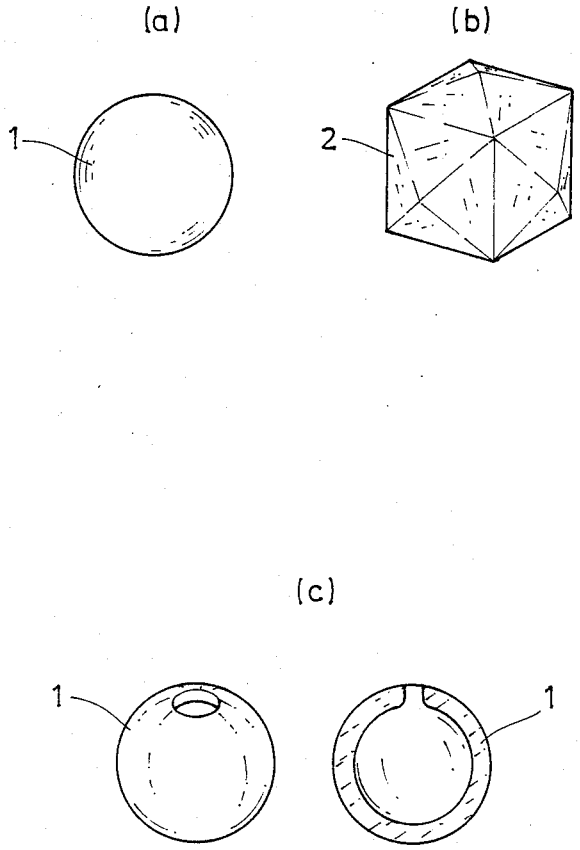
FIG. 19 (*a*) is an explanatory view of an ice ball.

Preferred embodiments of the automatic ice making machine according to this invention is described below with reference to the accompanying drawings. According to the automatic ice making machine of this invenion, diamond-cut polyhedral ice cakes 2 as illustrated in FIG. 19 (*b*) can also be made as well as the ice balls as illustrated in FIG. 19 (*a*). However, the following embodiment will be described with reference to a case where a large number of ice balls of the same size are continuously made. At least three types of typical mechanisms are proposed as the preferred embodiments and each of them will be illustrated below.

Freezing Mechanism of First Embodiment

Figure 1:
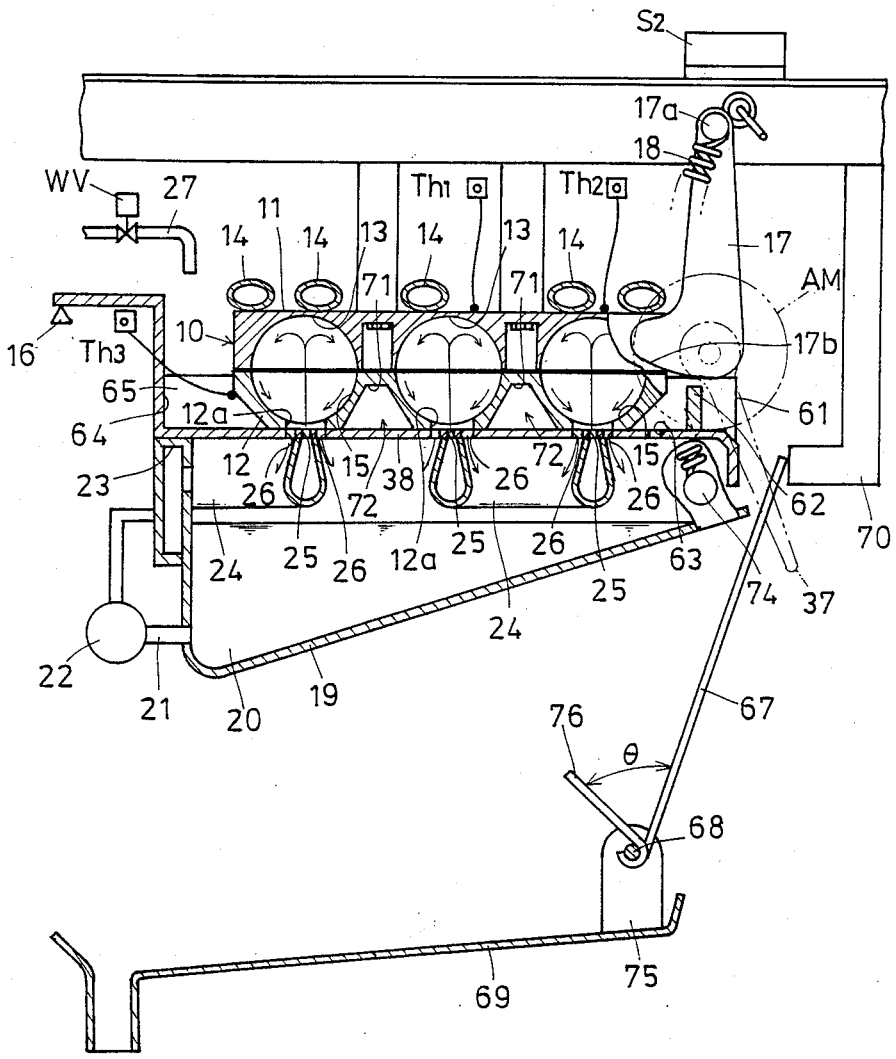
FIGS. 1 to 9 each show a longitudinal cross-sectional view illustrating a schematic construction of the automatic ice making machine according to the first embodiment of this invention.

FIG. 1 is a schematic representation of a principal mechanism for making ice balls according to the first embodiment of this invention, wherein, an ice making chamber 10 for making a multiplicity of ice balls with a predetermined diameter may basically be composed of a first freezing chamber 11 horizontally disposed within the machine, and a second freezing chamber 12 which can be pivotally turned upwardly to close the first freezing chamber 11. That is, the rectangular first freezing chamber 11 made of a highly heat-conductive metal is disposed horizontally at the internal upper portion of the machine housing (not shown) and a multiplicity of first freezing cells 13 are defined in the first freezing chamber 11 to be arranged neatly in the form of recesses having a predetermined pattern to open downwardly. Each of the first freezing cells 13 is in the form of a semispherical recess, for example, having a diameter of 3 cm and a depth of 1.5 cm. On the upper surface of the first freezing chamber 11, an evaporator 14 led out of a freezing system (not shown) is closely fixed in a zigzag manner, which conducts heat exchange with the vaporizing refrigerant in the evaporator 14 upon operation of the freezing system to cool the first freezing chamber 11 below the freezing point.

Immediately below the first freezing chamber 11, a second freezing chamber 12 made of a highly heat-conductive metal such as copper is tiltably disposed as described later. The first freezing chamber 11 is designed to be closed from downside during the ice making operation; whereas during the ice removing operation, the first freezing chamber 11 is designed to be opened. That is, in the second freezing chamber 12, a multiplicity of second freezing cells in the form of semi-spherical recesses with a predetermined pattern are defined to open upward, corresponding to the first freezing cells 13 defined in the first freezing chamber 11. The second freezing cell 15 is designed to have a diameter of 3 cm and a depth of 1.5 cm. Consequently, when the first freezing chamber 11 is closed from downside with the second freezing chamber 12, the first and second freezing cells 13 and 15 may be matched with each other cor respondingly to define spherical spaces therebetween each having a diameter of 3 cm.

Figure 11:
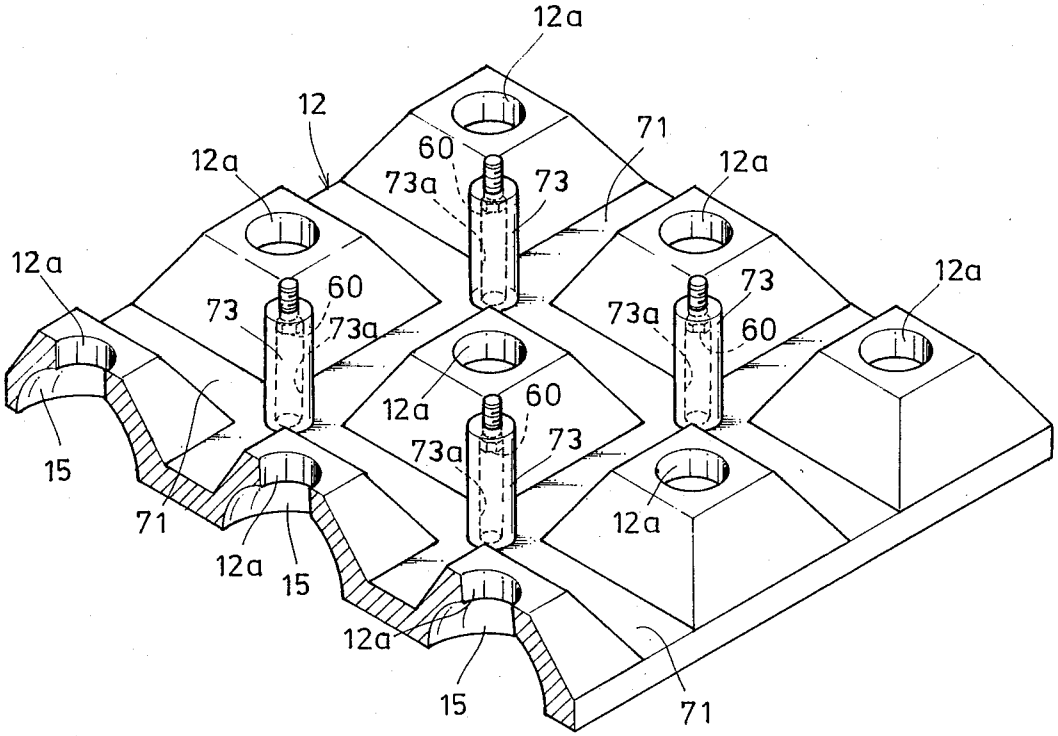
FIG. 11 is a schematic perspective view when the second freezing chamber which is vertically cutaway is viewed from the rear side.

The second freezing chamber 12 is a block body made of a highly heat-conductive metal such as copper as described above, and a water tray 38 for injecting water into each of the second freezing cells 15 is integrally fixed to the outer bottom of the second freezing chamber 12 with a bolt 60 illustrated in FIG. 11. As shown in FIG. 11, a channel 71 which opens downwardly between every two adjacent second freezing cells 15 is formed on the surface opposite to the one on which second forming cells 15 are formed (the surface opposing the water tray 38) of this second freezing chamber 12.

That is, while each of the second freezing cells 15 is surrounded by the channel 71 along the rear surface of the second freezing chamber 12, lower opening of this channel 71 is sealed by the water tray 38. In the ice removing operation which will be described later, the tap water supplied through a water supply valve WV is adapted to fill the channel passage 72 defined between each channel 71 and the surface of the water tray to elevate the temperature within the freezing cells 15.

At a predetrermined position of the channel 71 in the second freezing chamber 12 a support post 73 having the same size as the depth of the channel 71 is mounted protrudingly, and the above-described bolt 60 is inserted into a hole 73*a* formed through this support post 73. The second freezing chamber 12 is fixed to the water tray 38 by means of a bolt, with the tip end portion of the support post 73 and the sites where through holes 12*a* to be described later are formed being abutted against the surface of the water tray 38.

Figure 6:
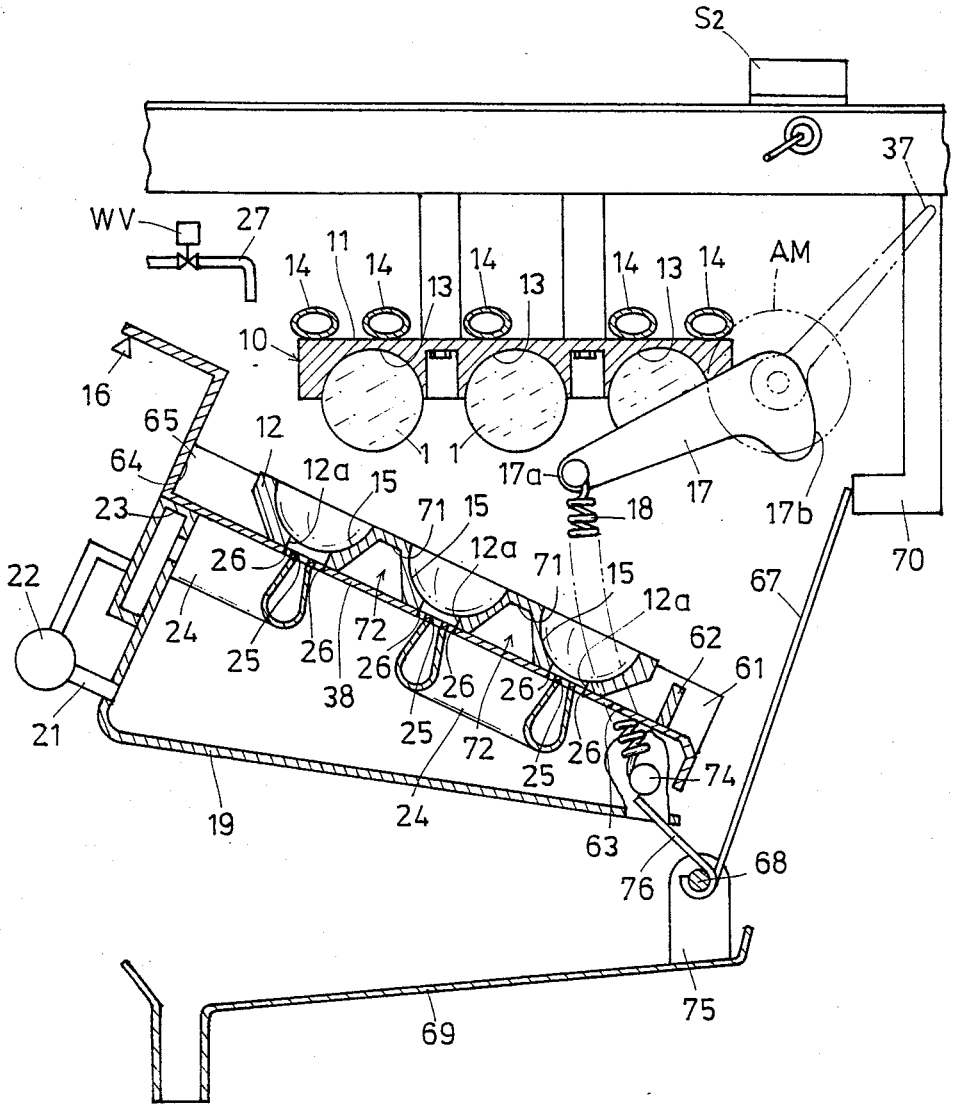

The water tray 38 has a rear end portion upstanding with a right angle to form a rear portion 64, while the open end of this rear portion 64 is pivotally supported at the fixing site of the housing of the ice making machine (not shown) through a pivot 16 so that it may be urged to turn along with the second freezing chamber 12 by means of an actuator motor AM to be described later. That is, as shown in FIG. 6, when the water tray 38 is turned clockwise, the second freezing chamber 12 integrally fixed to the water tray 38 opens relative to the first freezing cells 13, whereas, when the water tray 38 is turned counterclockwise, as shown in FIG. 1, the second freezing chamber closes the first freezing cells 13.

On the rear surface of the water tray 38, a distributor pipe 24 for supplying the water to be frozen is disposed in a zigzag manner, and this distributor pipe 24 alignedly communicates with each of the second freezing cells 15 through respective water injection holes 25 and through holes 12*a* to be described later. As shown in Figure, a through hole 12*a* is formed on the bottom of each second freezing cell 15 in the second freezing chamber 12, and when the above-described water tray 38 and the second freezing chamber 12 are combined, each water injection hole 25 is designed to have a dimension to allow alignment with the respective through hole 12*a*. The through holes 12*a* function so that they may supply the water to be frozen into the spaces for forming ice balls which are defined between the first and second freezing cells during the freezing operation to be described later, while the water which is not frozen within the spaces (hereinafter referred to as "unfrozen water") is discharged properly. A water recovering hole 26 is formed adjacent to each water injection hole 25 in the water tray 38 and the unfrozen water discharged from the through holes 12*a* is fed back through the water recovering holes to a water tank 19 provided below the water tray 38.

Water Tray Tilting Means and Water Circulation System

The actuator motor AM for tilting the water tray 38 is provided with a reduction gear, and a cam lever 17 and a lever piece 37 are fixed to the rotary shaft of the reduction gear such that they may extend radially, and a coil spring 18 is resiliently engaged across the tip end 17*a* of the cam lever 17 and a catch 74 which protrudes from the forward end of the water tray 38. This catch 74 also serves to urge an ice guide plate 67 (to be described later) to be tilted during the ice removing operation to be described later. The cam surface 17*b* formed at the hinge portion of the cam lever 17 is designed to have dimensions so that it may engage with the upper surface of the lateral wall 61 of the water tray 38. A change-over switch $S_2$ is disposed at a fixing site where the first freezing chamber 11 is supported, and when the above-described lever piece 37 is turned as the motor AM rotates during the ice removal operation, the change-over switch $S_2$ is switched over to stop the motor AM in turn to stop the water tray 38 in a tilted posture. The motor AM also switches the valve of the freezing system to circulate a hot gas through the above-described evaporator 14.

A water supply pipe 21 led out of the lateral wall at the lower part of the water tank 19 communicates with a pressure chamber 23 provided beside the tank via a water supply pump 22 and further with the above distributor pipe 24 from the pressure chamber 23.

Consequently, the water to be frozen being fed under pressure from the water tank 19 via the pump 22 is injected into each of the second freezing cells 15 through the injection holes 25*a* formed along the distributor pipe 24 and the through holes 12*a* formed at the bottom of the respective second freezing cells 15. If the above-described through holes 12*a* are designed to have a sufficiently large diameter, the unfrozen water, which has not been frozen in the first and second freezing cells 13 and 15 during the freezing operation to be described later, can be fed back to the water tank 19 through the through holes 12*a* and the water recovering holes 26 formed in the water tray 38. Further, a dam 62 is disposed at a forward portion of the water tray 38 which is fixed at a level lower than that of the above lateral wall 61 with a predetermined value, and the both ends of this dam 62 are closely attached to the lateral walls 61 on both sides. A drain hole 63 of a desired diameter is formed through the water tray 38 between the forward lateral end of the second freezing chamber 12 and the dam 62. As a result, a water reservoir 65 surrounded by the two lateral walls 61, dam 62 and the rear portion 64 is defined on the internal surface of the water tray 38, wherein the water stored within the water reservoir 65 fills the channel passage 72 defined between the channel 71 of the second freezing chamber 12 and the water tray 38 to warm each of the second freezing cells 15. The water stored in the water reservoir partly flows down from the drain hole 63 to the water tank 19, while the other part of water is adapted to overflow from the upper end of the dam 62 to flow from the forward side of the water tray 38 into the tank 19. Supply of the water into the water tank 19 may be achieved by opening the water supply valve WV of the water supply pipe 27 connected to the external water supply system.

Heat Sensor Mechanism

At a predetermined position of the upper surface of the first freezing chamber 11, a heat-sensor (probe) of a thermostat $Th_1$ for detecting formation of ice balls is disposed which serves as a means for detecting completion of the freezing operation, and at another position of the upper surface of the same first freezing chamber, a heat-sensor of a thermostat $Th_2$ for detecting removal of ice balls is disposed which serves as a means for detecting completion of the removal of ice balls. At a desired lateral portion of the second freezing chamber 12, a heat-sensor of a thermostat $Th_3$ is disposed, and the body of the thermostat $Th_3$ which emits electrical signals is attached to the rear portion 64 of the water tray 38.

Ice Guide Plate

Figure 10:
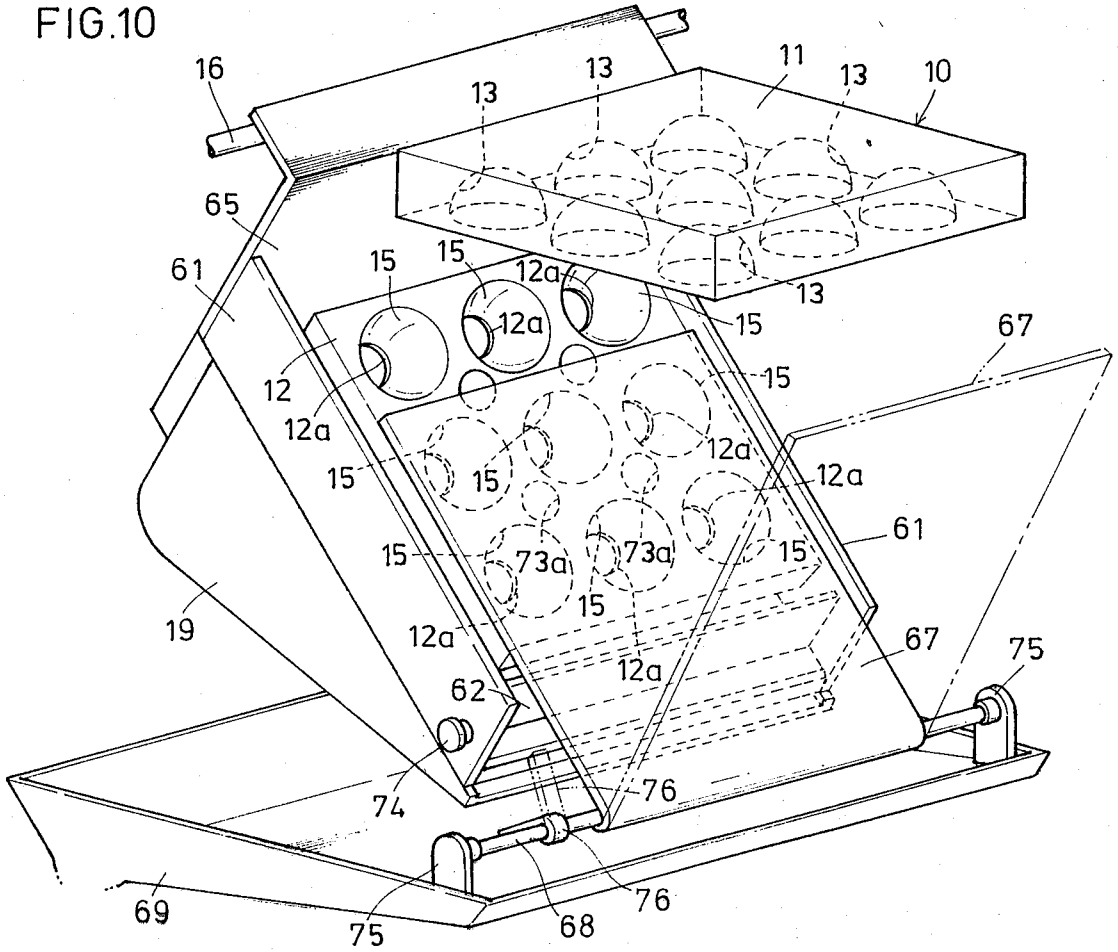
FIG. 10 is a schematic perspective view of FIG. 7.

Below the water tank 19, is disposed a drain tray 69 for discharging the unused water and the like to the outside of the machine after the freezing operation, and an ice guide plate 67 fixed to a shaft 68 is disposed above the drain tray 69. That is, a pair of bearings 75 protrude from the drain tray 69, as shown in FIG. 10, at a position which is inner with a predetermined distance from its forward end and spaced widthwise from each other with a predetermined interval (at outer positions relative to the both lateral portions 61 of the water tray 38), and the shaft 68 is pivotally supported by these bearings 75. To this shaft 68, the lower end portion of the ice guide plate 67 which is designed to have a width shorter than the interval between the two lateral walls 61 of the water tray 38 and can cover the entire upper surface of the second freezing chamber 12 is fixed, and this ice guide plate 67 can be turned integrally with the shaft 68.

Figure 5:
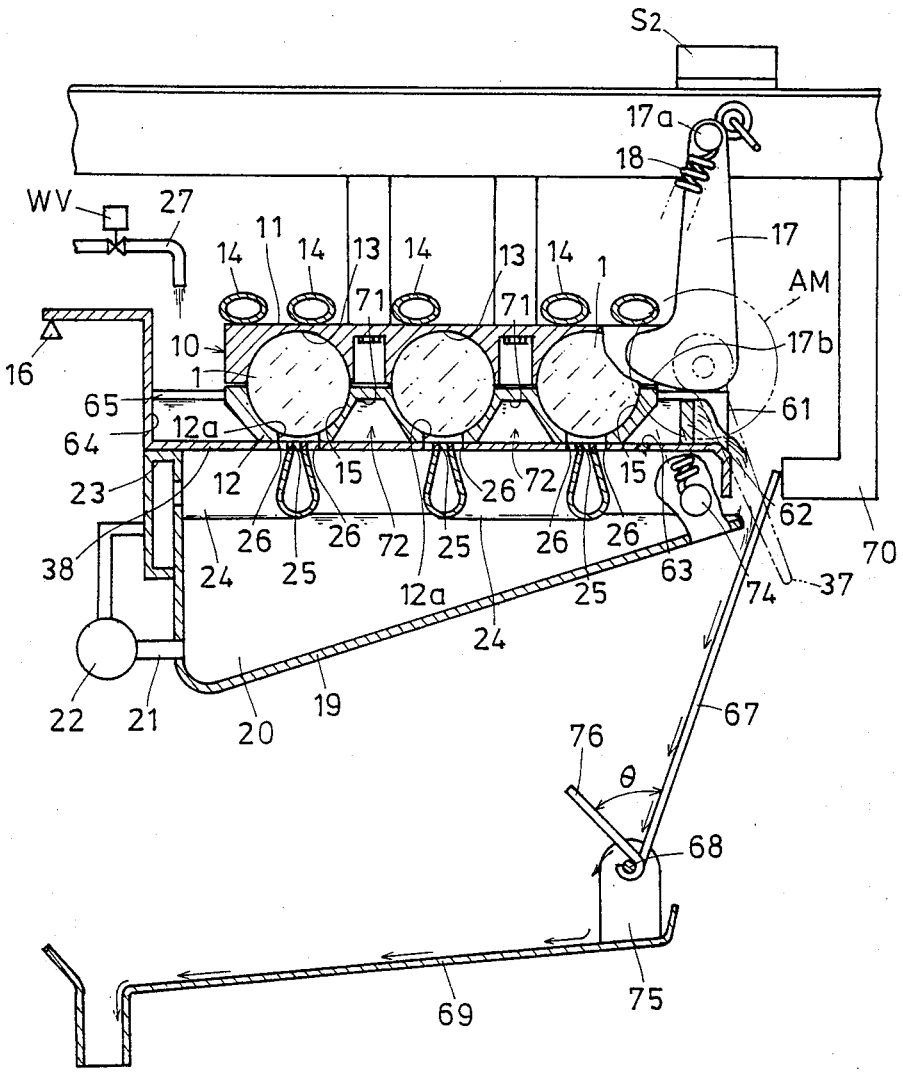

The upper end portion of the ice guide plate 67 is positioned so that it may be abutted against a positioning member 70 extended downwardly from the fixing site of the housing during the freezing operation to stop at a position proximate to the open tip end of the tank 19, as shown in FIG. 1. In this state, when the water to be frozen within the tank 19 overflows, as shown in FIG. 5, this water flows down along the rear surface of the ice guide plate 67 and is then discharged to the outside of the machine from the drain tray 69.

Figure 8:
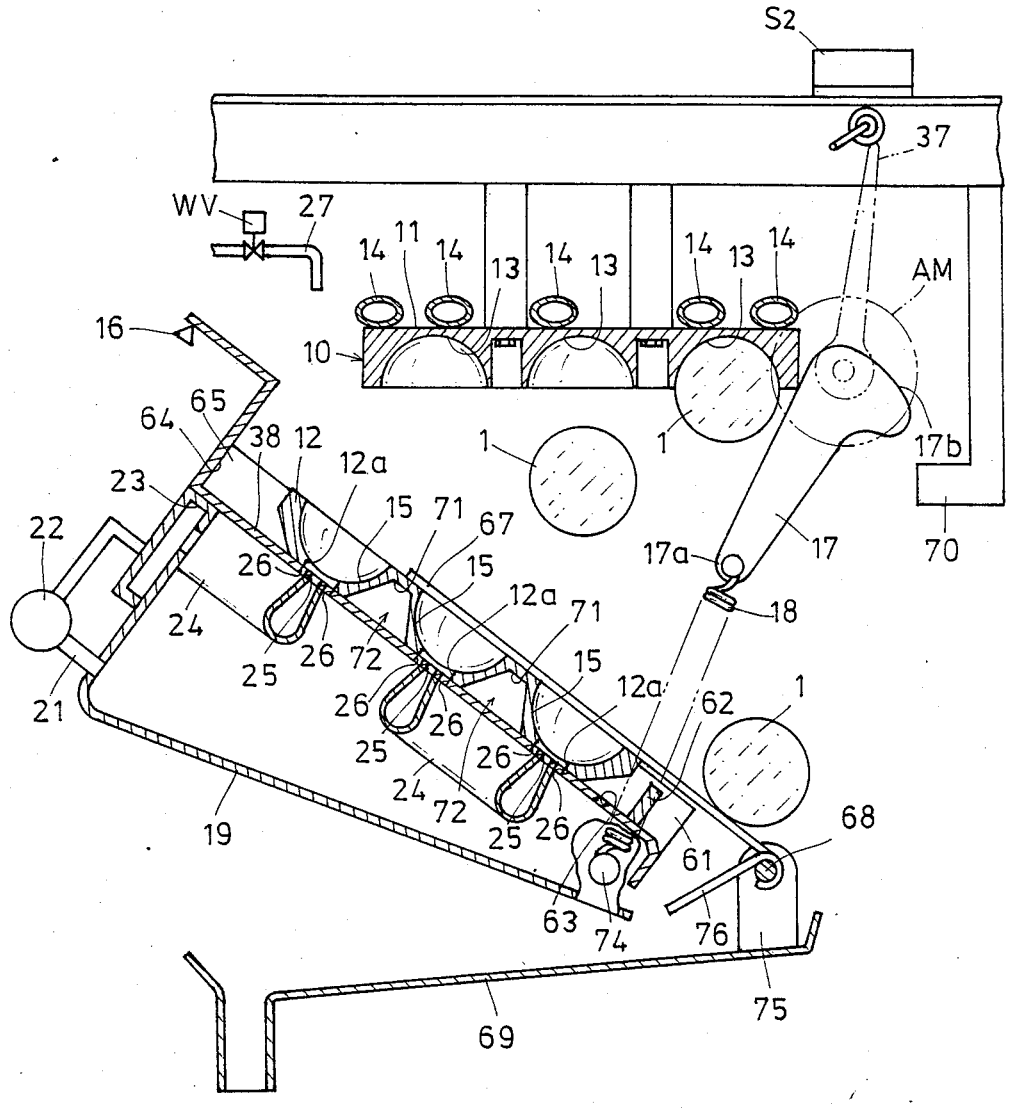

As shown in FIG. 10, to the shaft 68 is protrudingly fixed an inversion lever 76 adjacent to the ice guide plate 67, and this inversion lever 76 is disposed at a position turned inwardly of the drain tray 69 with an angle $\theta$ relative to the ice guide plate 67 toward the inside (see FIG. 1). This inversion lever 76 is in the travelling locus of the catch 74 protruding from the lateral portion of the water tray 38 which may be tilted during the ice removing operation (to be described later), and when the catch 74 of the water tray 38, which turns clockwise on the pivot 16 as the fulcurum, is abutted against the inversion lever 76, the ice guide plate 76 is turned counterclockwise together with the lever 76. Then, when the catch 74 of the water tray 38 further turns depressing the inversion lever 76, the ice guide plate 67 inclines to the left relative to the perpendicular line extending upwardly from the shaft 68, and falls over the inclined upper surface of the second freezing chamber 12 to block the second freezing cells 15 opening upwardly since the gravity center of the ice guide plate 67 is shifted. As shown in FIG. 8, the ice balls which drop from the first freezing chamber 11 can then be slided down along this ice guide plate 67 to guide them smoothly to the ice reservoir (not shown).

When the ice removal operation is completed and the water tray assembly is turned counterclockwise on the pivot 16, the ice guide plate 67 which has fallen over the inclined upper surface of the second freezing chamber 12 is pressed by the tip end of the water tray 38 and turned clockwise around the shaft 68. When the ice guide plate 67 is tilted to the right relative to the above-described perpendicular line, the gravity center of the guide plate 67 is shifted and the guide plate 67 is separated from the water tray 38 to further turn clockwise by its own weight until it is positioned being abutted against the positioning member 70.

Figure 12:
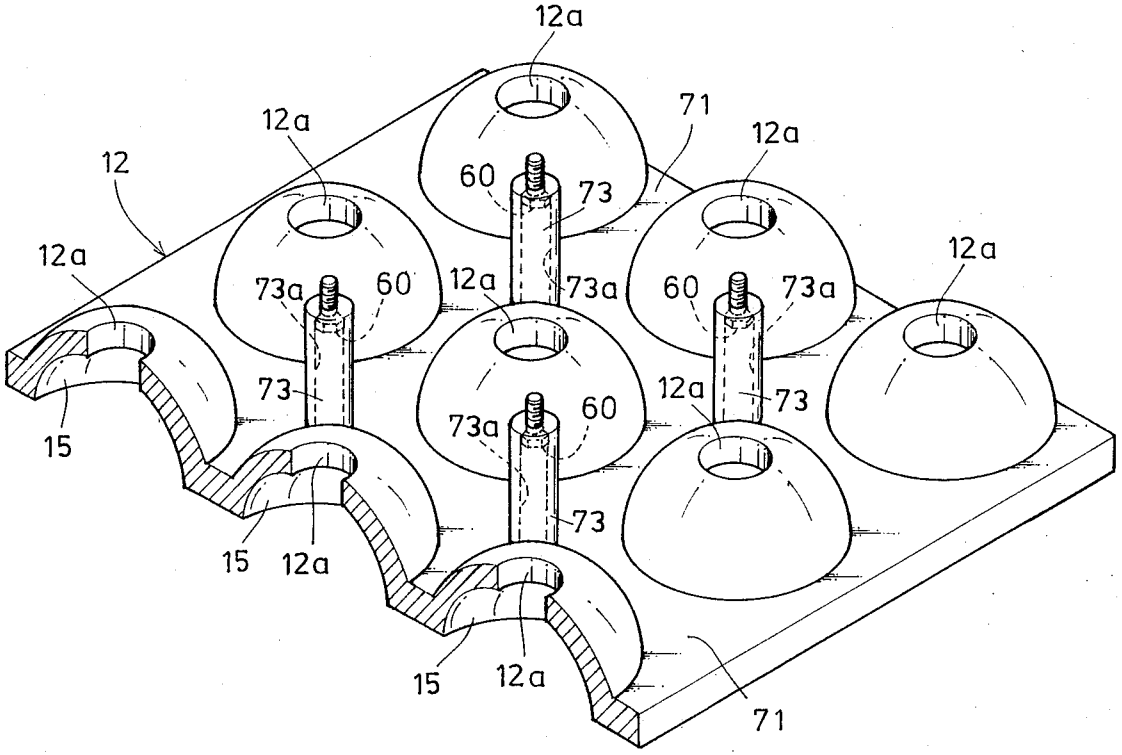
FIG. 12 is a schematic perspective view when a variation of the second freezing chamber which is vertically cutaway is viewed from the rear side.

Next, FIG. 12 illustrates a variation of the second freezing chamber 12 to be employed for the automatic ice making machine of this invention. This second freezing chamber 12 is made of a thin member such as a metal sheet, and a multiplicity of second freezing cells 15 formed into semispherical recesses are arranged in a predetermined pattern to open upwardly when it is incorporated in the machine. More specifically, each of the second freezing cells 15 is formed in the form of concave on the internal surface (the side opposing the water tray 38) of the thin member, and a desired shape of channel 71 is formed on the rear surface between every two adjacent freezing cells 15. The second freezing chamber 12 is fixed, with the apex of each second freezing cell 15 being abutted against the water tray 38, and a channel passage 72 which serves as a flow path for the external tap water in carrying out the ice removing operation (to be described later) is defined between the channel 71 and the surface of the water tray 38.

At the apex of each second freezing cell 15 a through hole 12*a* which communicates with the water injection hole 25 of the water tray 38 is formed. This through hole 12*a* supplies the water to be frozen into the ice formings spaces defined between the first and second freezing cells 13 and 15 while discharging the unfrozen water.

Operation of the First Embodiment

Next, the operation of the ice making machine according to the first embodiment is described.

First, in the freezing operation, as shown in FIG. 1, the first freezing chamber 11 is closed with the second freezing chamber 12 from downside to align each of the first freezing cells 13 with the respective second freezing cells 15, so that the ice forming spaces may be defined therebetween. If the power is turned on in the machine in this state, the freezing operation is started and the refrigerent is circulatingly supplied into the evaporator 14 provided at the first freezing chamber 11 to cool the first freezing chamber 11. The water to be frozen 20 from the water tank 19 is fed under pressure to the distributor pipe 24 by means of a pump and injected into the spherical spaces defined by the first and second freezing cells 13 and 15 through the injection holes 25 and the through holes 12*a* of the second freezing cell 15.

The injected water to be frozen is cooled upon contact with the internal surface of the first freezing cells 13, and after filling the second freezing cells 15 below the first freezing cells, it is discharged from the above-described spherical spaces through the plurality of through holes 12*a*. This unfrozen water is fed back to the water tank 19 for recirculation via the above-described water recovering holes 26 formed in the water tray 38. As the circulation of the water is repeated, the temperature of the entire water stored within the tank 19 is gradually lowered, while the temperature within the second freezing cells 15 is also gradually lowered.

Figure 2:
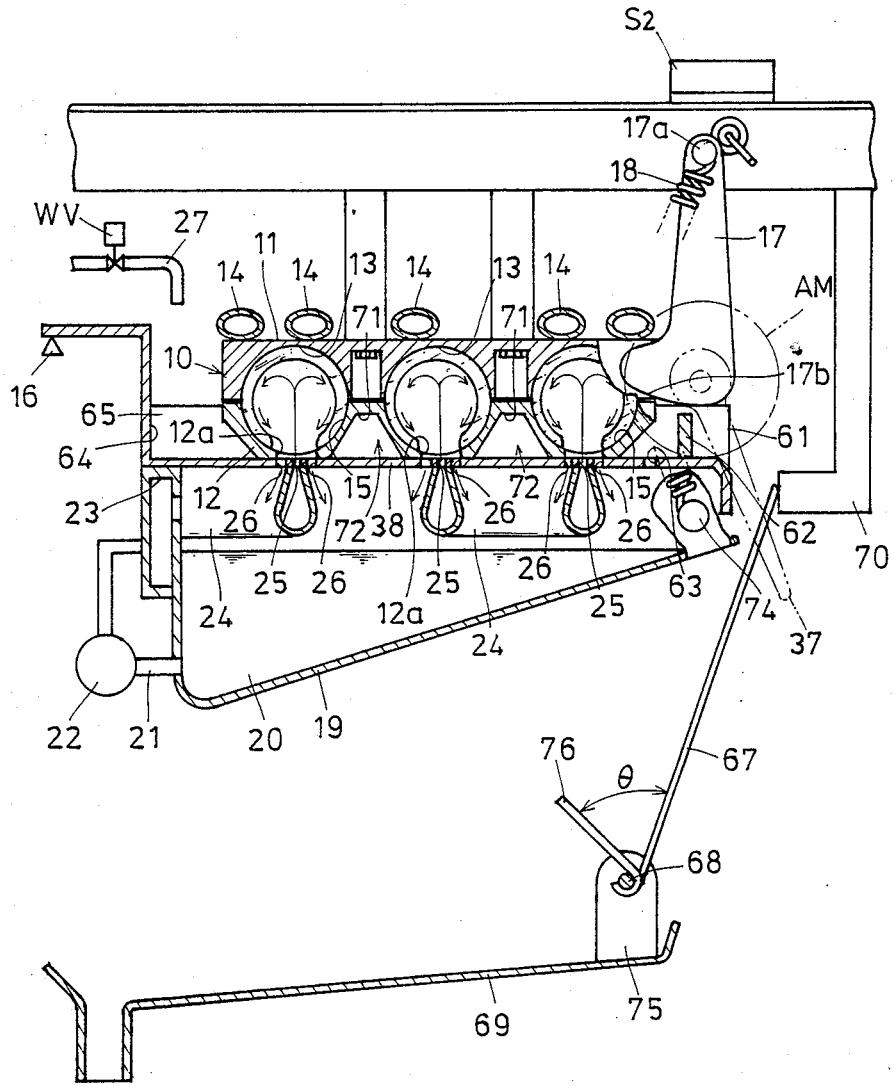
Figure 3:
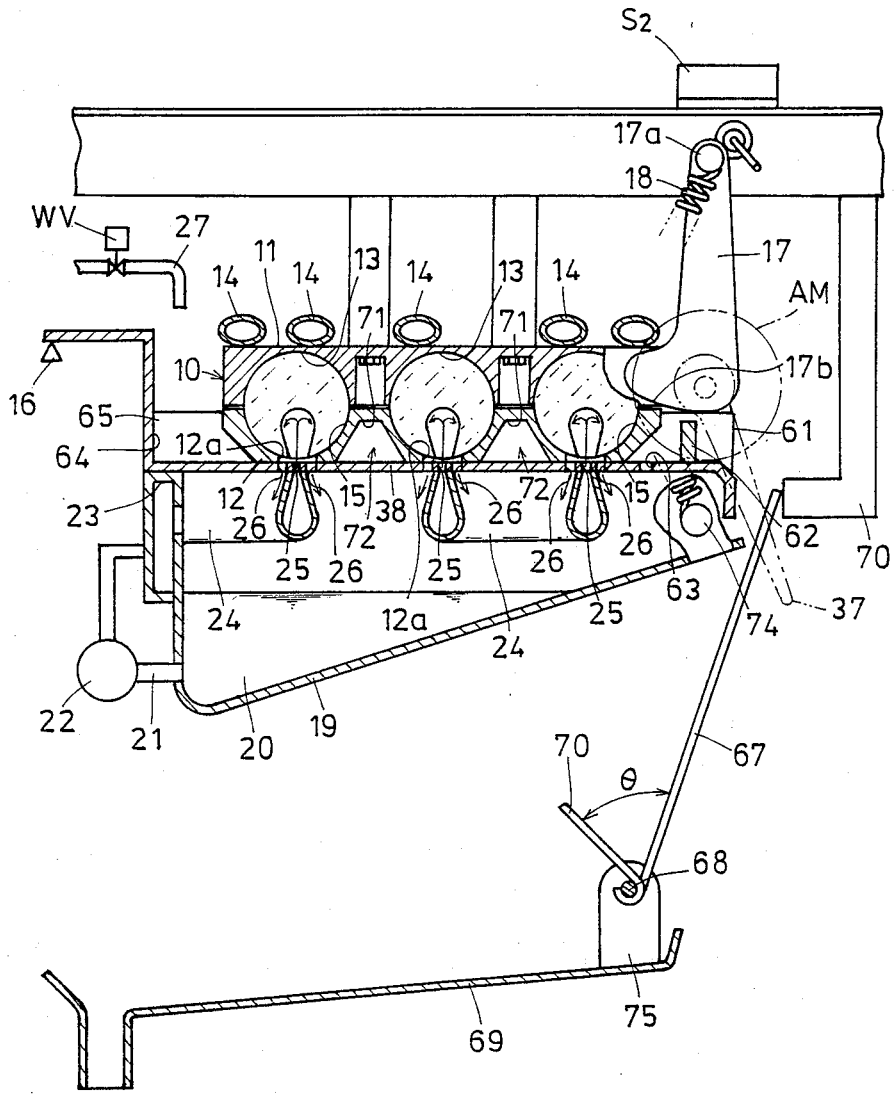
Figure 4:
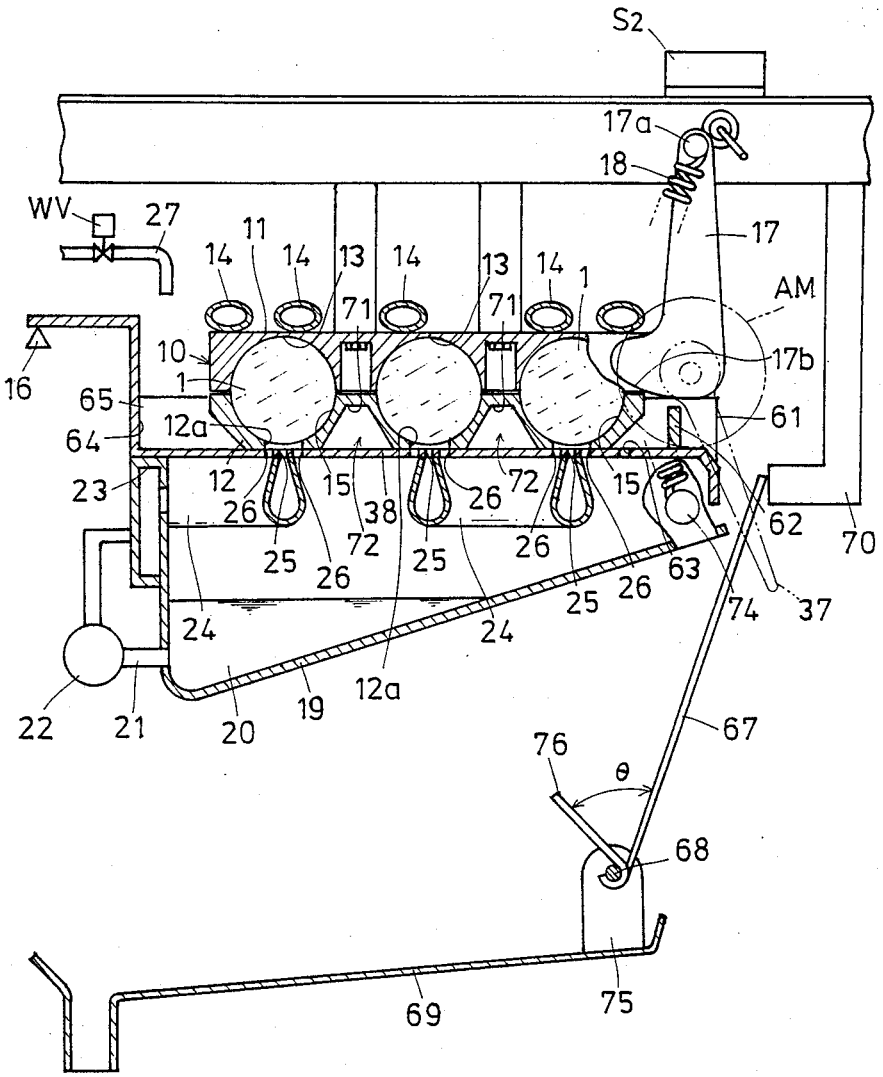

Then, part of the water is first frozen along the internal wall surface of the first freezing cells and an ice layer starts to form (see FIG. 2). While the unfrozen water is repeatedly fed back through the through holes 12*a* and the water recovery holes 26 to the tank 19, the growth of the ice layer further proceeds, and as shown in FIGS. 3 and 4, ice balls 1 are finally formed within the spherical spaces defined by the first and second freezing cells 13 and 15. If the freezing operation is terminated at the time when the frozen state as shown in FIG. 2 is achieved, the hollow spherical balls as shown in FIG. 19 (*c*) can be obtained. The hollow ice balls thus obtained can serve to create a new demand for ice if food such as cherry, beverage such as a juice or an ornamental object such as a petal is included within the internal space. Besides, one can blow air through the opening (the opening corresponding to the water injection hole 25 or the water recovery hole 26) of a hollow ice ball with his or her lower lip applied thereto, to use it as a flute (ice flute) offering a particular elegance.

Referring more specifically to the process in which ice balls are made, since the second freezing chamber 12 is made of a highly heat-conductive metallic material such as copper, as described above, heat conduction through the first freezing chamber 11 is excellently achieved to attain proper cooling temperature which is substantially the same as in the first freezing chamber 11 at an early stage. As a result, an ice layer is formed in the second freezing chamber 12 as well as in the first freezing chamber 11 to assume a state as shown in FIG. 2. Further, since channels 71 are formed along the rear surface of the second freezing chamber 12, the volume of the second freezing chamber 12 is reduced, whereby the thermal load is significantly reduced to improve cooling efficiency.

When the process of making ice balls is completed as shown in FIG. 4, and the temperature within the first freezing chamber 11 drops to a predetermined temperature range, this temperature drop is detected by the ice formation detecting thermostat $Th_1$, and the circulatory supply of the water to be frozen is stopped, while the supply of the refrigerant into the evaporator 14 is continued. Then, as shown in FIG. 5, the water supply valve WV is opened to start feeding of the water into the water reservoir 65 defined on the surface of the water tray 38. Since the amount of the tap water supplied via the water supply valve WV is much larger than that of the water which flows down through the drain hole 63 to the tank 19, the water level in the water reservoir 65 is gradually elevated until it finally overflows from the dam 62 of the water tray 38. If the overflow water level in the reservoir 65 is previously designed to come near the upper end of the second freezing chamber 12, the tap water of normal temperature can mainly warm the second freezing chamber 12.

At this time, since the channel 71 is formed around each second freezing cell 15 of the second freezing chamber 12, the channel passage 72 defined between this channel 71 and the surface of the water tray 38 is filled with water, thereby a sufficiently large contact area can be secured between the water and the second freezing chamber 12. Consequently, a heat exchange efficiency between the water and the second freezing chamber 12 will be improved to reduce the time required for the ice removing operation.

The water overflowing from the dam 62 flows down into the tank 19 from the fore end of the water tray 38. The water level within the tank 19 is gradually elevated due to the water flowing thereinto from this fore end portion of the water tray and the water flowing down through the drain hole 63 until at last the water overflows from the top of the tank in a short period of time to be discharged to the outside of the machine from the drain tray 69 along the ice guide plate 67 which is located at the above-described stand-by position.

The second freezing chamber 12 is warmed by the tap water which flows into the water reservoir 65 and the channel passage 72, and the freezing power is reduced between the wall surface of the second freezing cells 15 and the ice balls. The binding force of the ice formed along the surface adjacent to the first freezing chamber 11 is also weakened. As described above, if the temperature of the second freezing chamber 12 is elevated, this temperature rise is detected by the above-described thermostat $Th_3$ to close the water supply valve WV, while the motor AM is energized to start counterclockwise rotation, as shown in FIG. 1. As a result, as shown in FIG. 6, the cam lever 17 is turned and the cam surface 17*b* formed at the hinge portion forcedly presses the top of the lateral wall of the water tray 38 downwardly. As already described, since the second freezing chamber 12 has been warmed by the tap water, and the binding force between the first freezing chamber 11 and the ice balls 1 is moderated, the water tray 38 and the second freezing chamber 12 are forcedly separated from the first freezing chamber 11 to begin to tilt downwardly. Due to this tilting action of the water tray 38 and the tank 19, the water to be frozen within the tank 19 and the water within the water reservoir are thrown away to the outside of the machine.

In the middle of the process of tilting the water tray 38, as shown in FIG. 6, the catch 74 protrudingly provided to the water tray 38 is abutted against the inversion lever 76 disposed integrally with the shaft 68 to turn the inversion lever 76 counterclockwise. When the ice guide plate 67 turns as the inversion lever 76 tilts to the left relative to the perpendicular line, as described above, the ice guide plate 67 is inverted to be tilted, bearing against the water tray 38. When the water tray 38 is tilted to the maximum degree, the lever piece 37 presses and actuate the switch $S_2$ so that the motor AM may stop its rotation to stop the tilting action of the water tray 38. As described above, the ice guide plate 67 covers the upper surface of the second freezing chamber 12 to provide a smooth surface along which the ice cakes may slide down. (see FIG. 7)

Figure 7:
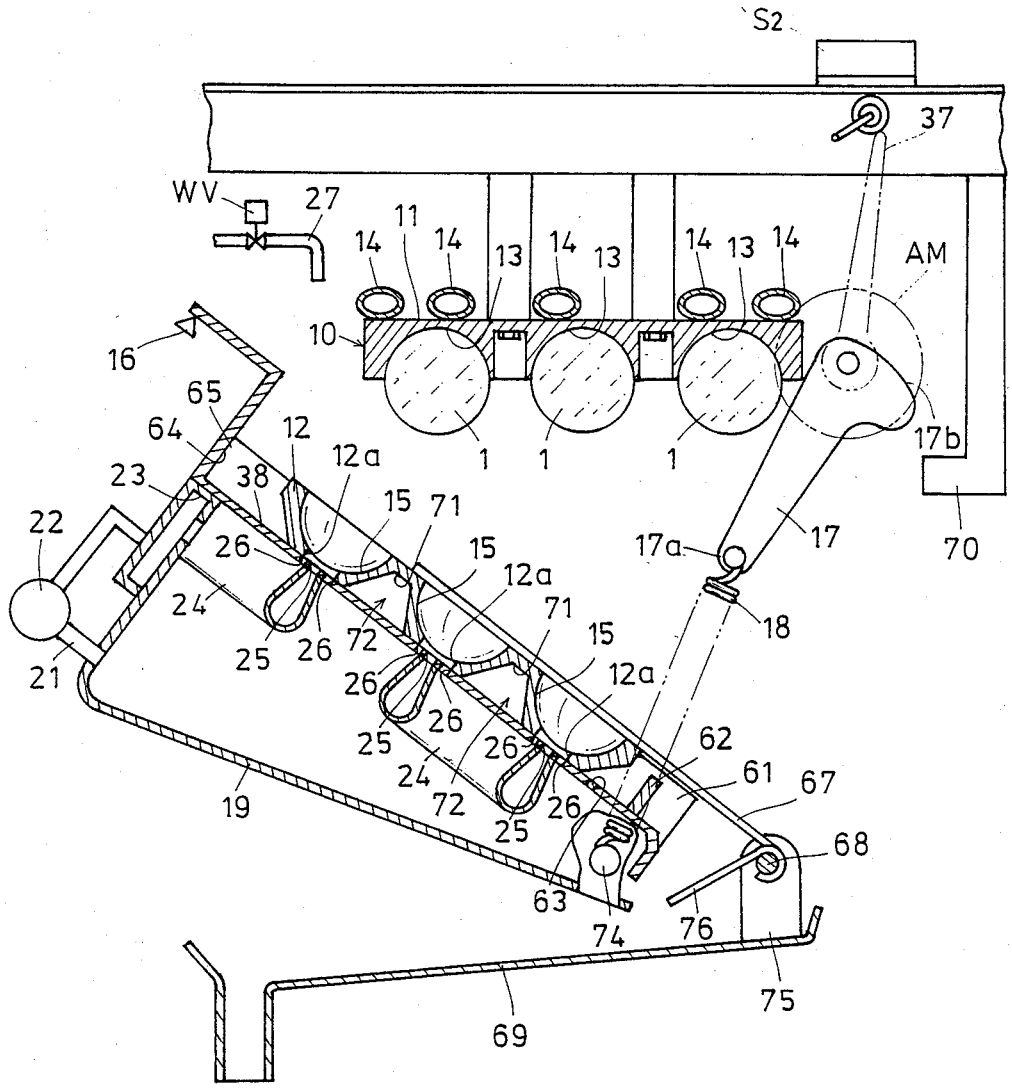

Upon switching of the change-over switch $S_2$, a fan motor (not shown) for condenser is stopped and a hot gas valve (not shown) is opened. A hot gas is thus supplied to the evaporator 14, and the first freezing chamber 11 is heated thereby, to start melting of the frozen interface between the internal surface of the first freezing cells 13 and the ice balls 1. As described above, since the first freezing chamber 11 has been cooled until the water tray 38 is tilted and opened, the freezing force (binding force) between the ice balls and the internal surface of the first freezing cells 13 is strong, and when the second freezing chamber 12 is opened, the ice balls 1, as shown in FIG. 7, are frozen to the first freezing cells 13. However, since the hot gas has already been circulating through the evaporator 14, the temperature of the first freezing chamber 11 is increasing. When the first freezing cells 13 are warmed to some degree, the ice balls frozen to the wall surface of the cells will be melted slightly and drop due to their own weight. As shown in FIG. 8, the ice balls drop onto the surface of the ice guide plate 67 which has previously been tilted in a stand-by posture, to slide down to be collected into the ice reservoir (not shown).

Figure 9:
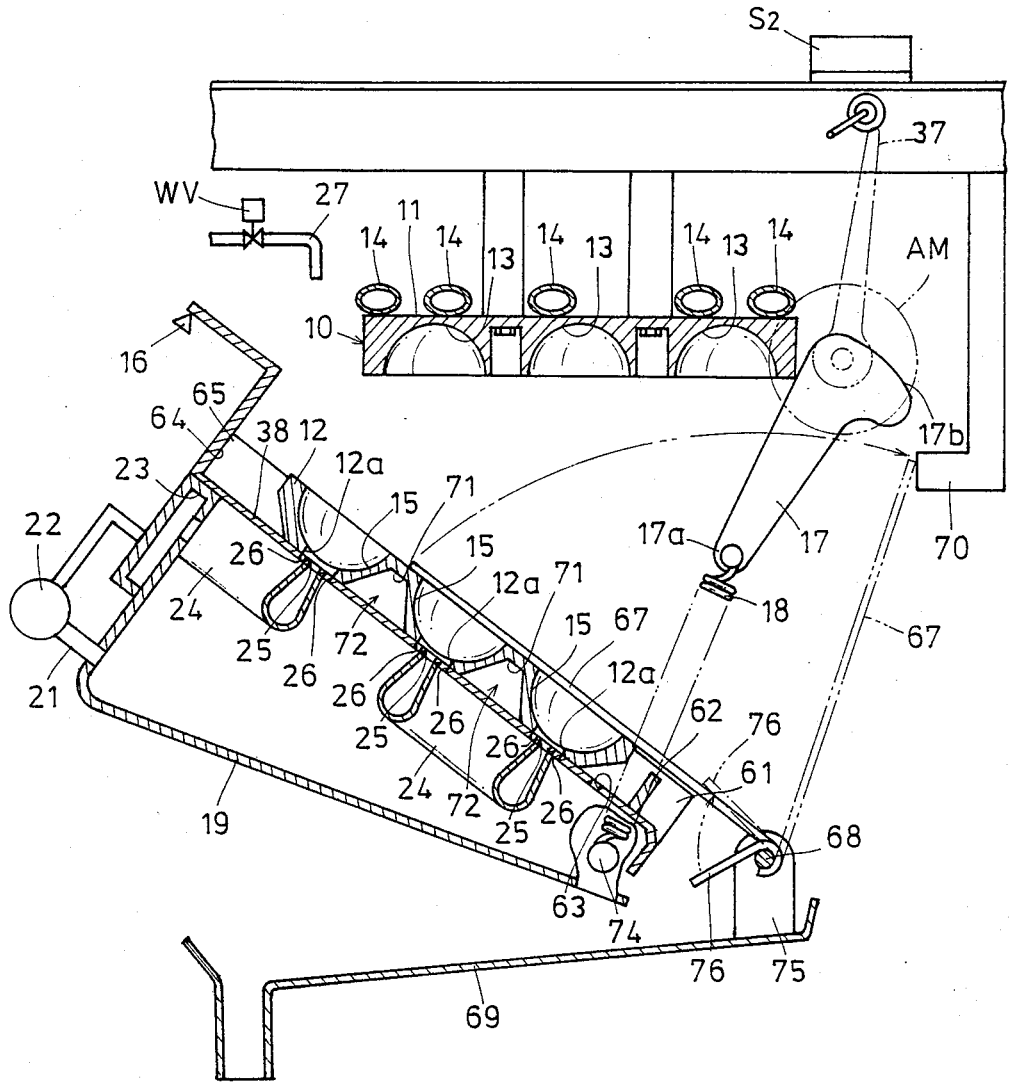

As described above, when all the ice balls are separated from the first freezing cells 13, as shown in FIG. 9, the temperature of the first freezing chamber 11 suddenly rises by the action of this hot gas circulating through the evaporator 14. When this temperature rise is detected by the ice removal detecting thermostat $Th_2$, the ice removing operation completes, while the above-described motor AM is reversed to drive the cam lever 17. Consequently, the water tray 38 and the water tank 19 are urged to turn counterclockwise with the aid of the coil spring 18 resiliently engaging between the lever 17 and the water tray 38 to return them to their initial horizontal postures to close the first freezing chamber 11 again therewith from downside.

When the water tray 38 returns to its initial position, the ice guide plate 67 is pressed by the water tray 38 returning to the horizontal posture, to turn clockwise so that it may resume the stand-by posture where the ice guide plate 67 is abutted against the above positioning member 70. Since the ice guide plate 67 can be urged to be tilted in relation with the tilting/returning action of the water tray 38 without using other driving means, the entire mechanism can be made simple and produced at a low cost, advantageously.

Subsequently, the cam lever 17 is also reversed by the reverse rotation of the motor AM to press the change-over switch $S_2$ for switching the valve of the above freezing system, so that the supply of the hot gas into the evaporator 14 may be stopped. The water supply valve WV may also be opened so that a fresh water to be frozen may be supplied to the tank 19 in which the water level has dropped. Then the freezing operation is resumed to repeat the above-described action. While the above embodiment referrs to a case where the ice guide plate is urged to be tilted in relation with the tilting/returning action of the water tray, the present invention is not limited thereto. It is also possible to rotate the above-described shaft using a driving means such as motor.

Freezing Mechanism According to the Second Embodiment

Figure 13:
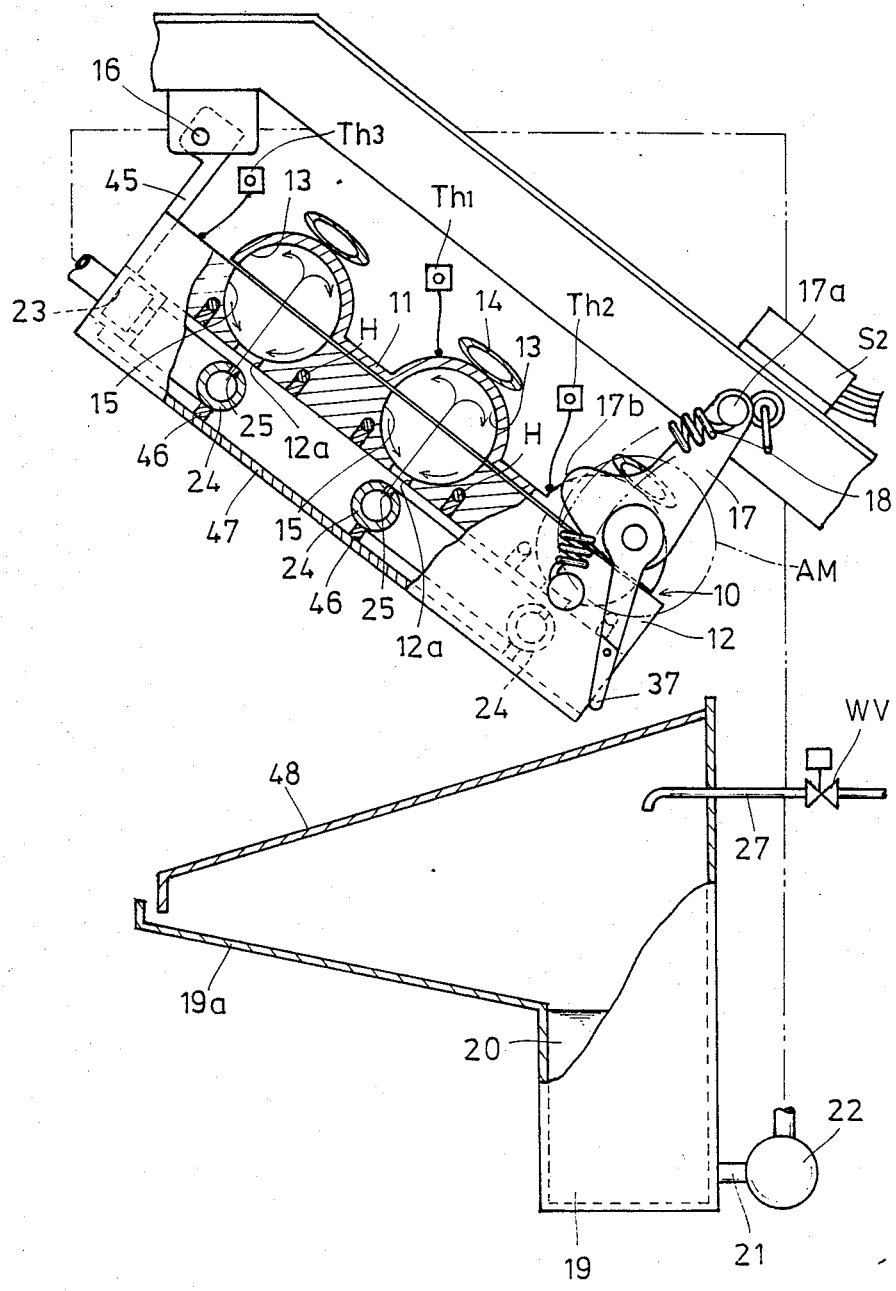
FIGS. 13 to 15 each show a second embodiment according to this invention.

FIG. 13 schematically illustrates an automatic ice making machine according to the second embodiment of this invention, under freezing operation. The first freezing chamber 11 shown in this embodiment is fixed at an internal upper part of the housing of the machine, tilted with a predetermined angle relative to the horizontal line. A multiplicity of first freezing cells 13 are provided in the form of semispherical recess arranged in a predetermined pattern on the lower surface of the first freezing chamber 11 in such a way that they may open downwardly, and the evaporator 14, ice formation detecting thermostat $Th_1$ and the ice removal detecting thermostat $Th_2$ are closely fixed at predetermined positions of the upper surface of the first freezing chamber 11.

Immediately below the first freezing chamber 11, the second freezing chamber 12 is disposed, which closes the first freezing chamber 11 from downside during the freezing operation, while it opens the first freezing chamber 11 during the ice removing operation. On this second freezing chamber 12, a multiplicity of second freezing cells 15 are also provided in the form of semispherical recess arranged in a predetermined pattern, corresponding to the first freezing cells, in such a way that they may open upwardly, and a heater H is embedded at the site close to each second freezing cell 15. At the bottom of each second freezing cell in the second freezing chamber 12, a through hole **12*a* with a predetermined diameter is provided, so that the supply of the water to be frozen through a distributor pipe 24** (to be described later) and the drainage of the unfrozen water may be achieved.

The upper end of the second freezing chamber 12 is mounted to a bracked 45 pivotally supported at the fixing site of an internal upper position of the housing of the machine with a pivot 16 so that it can be tilted. The bracket 45 is adapted to turn clockwise on the pivot 16 under the action of the actuator motor AM, to hang down and open the first freezing cells 13. On the rear surface of the second freezing chamber 12, a distributor pipe 24 equipped with a pressure chamber 23 is disposed closely thereto with a slight gap therebetween. Water injection holes 25 each corresponding to the second freezing cells 15 are formed through the distributor pipe 24. When the second freezing chamber 12 is closed relative to the first freezing chamber 11, each of these holes 25 is adapted to face correspondingly with the respective through hole **12*a* formed in the second freezing cells 15. On the lower surface of the distributor pipe 24, a water guide plate 47 is disposed with a spacer 46 to extend in parallel to the lower surface of the second freezing chamber 12. This water guide plate 47 recovers the unfrozen water dropping from the through holes 12*a* of the second freezing cells 15 during the freezing operation to guide it into the water tank 19 disposed below the water guide plate 47. The temperature sensor thermostat $Th_3$ is disposed at a predetermined position of the second freezing chamber 12 so that the temperature in the second freezing chamber 12** may be monitored.

In the apparatus according to this second embodiment, the water tank 19 is not integrally provided with the second freezing chamber 12, but it is disposed being separated therefrom below the second freezing chamber 12. That is, the water tank 19 is provided below the housing of the machine and immediately below the first and second freezing chambers 11 and 12, and has an inclined surface **19*a* extending upwardly in a tilted manner from the main body of the tank. As shown in FIG. 10, it is preferred that a second water guide plate 48 be tiltingly interposed between this inclined surface 19*a* and the above water guide plate 47. The second water guide plate 48 is located at a level above the upper end of the inclined surface 19*a*, with its lower edge bent downwardly, and the unfrozen water is guided to the inclined surface 19*a* along the bent edge, while the ice balls slide down along the second ice guide plate 48 during the ice removing operation to be collected into the ice reservoir. The water supply pipe 21 led out of the lateral wall at the lower portion of the water tank 19 communicates with the pressure chamber 23 through a water supply pump 22, whereas the supply of water into the tank 19 is achieved through the water supply pipe 27** connected to the external water supply system by opening the water supply valve WV.

Electrical Control Circuit

Figure 15:
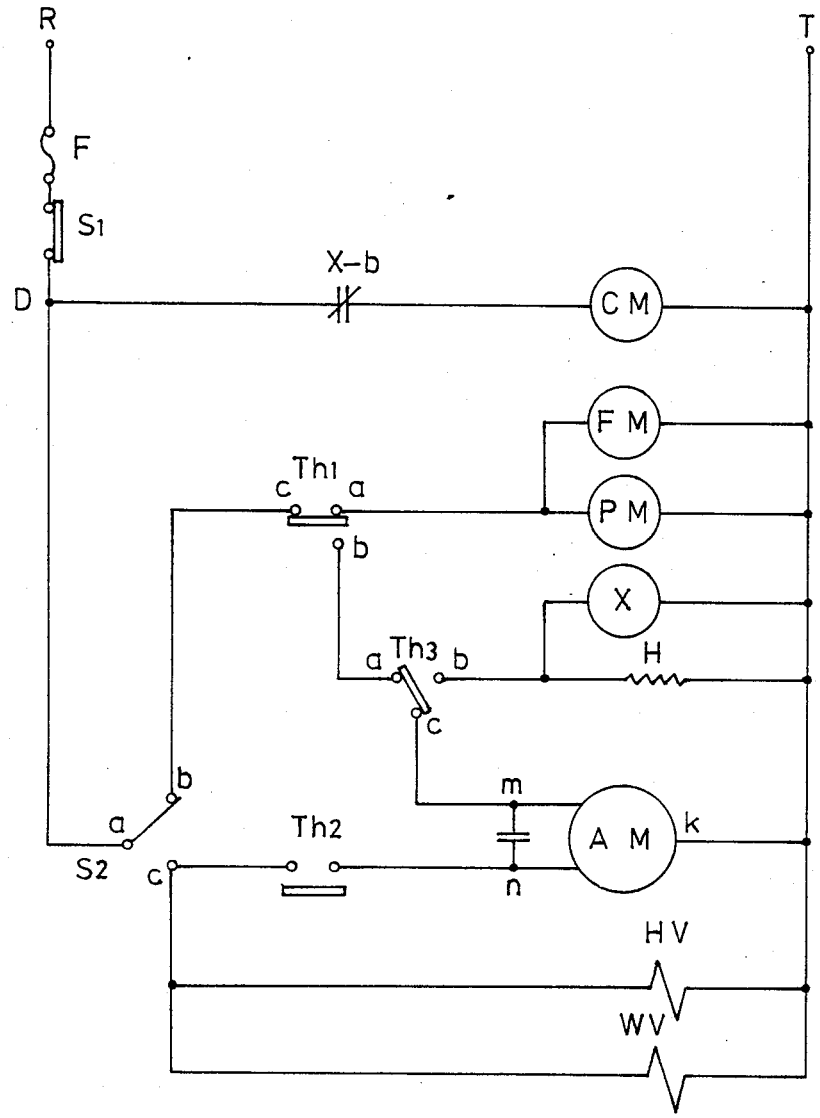

FIG. 15 illustrates an example of control circuit for actuating the apparatus shown in the second embodiment. In FIG. 15, a fuse F and a switch $S_1$ for detecting stored ice balls which are connected in series are provided between a power supply line R and a connecting point D, and a compressor CM connects between this connecting point D and a power supply line T via a normally closed contact X-b of a relay X. In the ice removing operation, a terminal a of the change-over switch $S_2$ actuated by the tilting action of the second freezing chamber 12 is connected to the connecting point D, and a change-over contact b for this change-over switch $S_2$ is connected to the contact c of the ice formation detecting thermostat $Th_1$.

A motor PM for driving the pump 22 and a fan motor FM are connected in parallel between the contact a of the thermostat $Th_1$ and the line T, and the contact b for the thermostat $Th_1$ is connected to the contact a for the thermostat $Th_3$ while the relay X and the heater H are respectively connected in parallel between the change-over contact b of the thermostat $Th_3$ and the line T. The connected to a terminal m for driving the actuator motor AM for achieving the tilting. A terminal k of the motor AM is also connected to the line T, while a return drive terminal n is connected to the change-over contact c of the change-over switch $S_2$ via the contact of the ice removal detecting thermostat $Th_2$. A hot gas valve HV and a water supply valve WV are connected in parallel between the change-over contact c of the change-over switch $S_2$ and the line T.

Operation of the Second Embodiment

The operation of the ice making machine according to the second embodiment is hereinafter described. First, the power is turned on in the machine. At this time, the switch $S_1$ for detecting the stored ice is closed and the change-over switch $S_2$ is connected via contacts a-b. Since the temperature of the first freezing chamber 11 is maintained approximately to room temperature, the ice formation detecting thermostat $Th_1$ is connected via contacts c-a. Consequently, upon turning on of the power supply, power is supplied to the compressor CM, fan motor FM and the pump motor PM to start freezing operation and cooling of the first freezing chamber 11. The water to be frozen 20 from the water tank 19 is fed under pressure to the distributor pipe 24 by means of pump to be injected through injection holes 25 of the distributor pipe 24 and through holes **12*a* formed in the second freezing chamber 12 into corresponding second freezing cells 15**, respectively.

The injected water to be frozen is cooled down upon contact with the internal surface of the first freezing cells 13, and after the lower second freezing cells 15 of the second freezing chamber 12 are filled with the water, it will drop onto the water guide plate 47 via the through hole **12*a* formed at the bottom of each second freezing cell 15 and returned to the water tank 19 via the second water guide plate 48 and the inclined surface 19*a* for recirculation. As this circulation of the water to be frozen is repeated, the temperature of the entire water to be frozen stored within the tank 19 gradually drops. Since part of the second freezing chamber 12 is brought into contact with the first freezing chamber 11 and the cooled unfrozen water is circulated being in contact with the second freezing cells 15, the temperature of the second freezing chamber 12 itself is also gradually lowered until it becomes below the freezing point. First, part of the water is frozen into an ice layer on the internal wall surface of the first freezing cells 13, and as the unfrozen water is fed back repeatedly to the water tank 19 via the through holes 12*a* for cycles, which also serve as the water recovering hole, the growth of the ice layer further proceeds until ice balls are gradually formed finally within the spherical spaces defined by the first and second freezing cells 13 and 15**.

As described above, when the freezing operation is completed in the first and second freezing cells 13 and 15, and the temperature of the first freezing chamber 11 drops to a predetermined range of temperature, the ice formation detecting thermostat $Th_1$ is switched, upon detection of the temperature drop, from c-a contact to c-b contact, and the power supply to the fan motor FM and the pump motor PM is stopped. On the other hand, since the temperature of the second freezing chamber 12 has been lowered below a predetermined temperature because of the ice balls 1 thus formed, the above temperature detecting thermostat $Th_3$ is brought into a-b contact. Consequently, the relay X is energized and excited to open the normally closed contact X-b, while the operation of the compressor CM is also stopped. Meanwhile, power is supplied to the heater H to heat the second frezing chamber 12, and the surface of the ice balls 1 in the second freezing cells 15 is melted, wherein the binding force between the ice balls 1 and the second freezing cells 15 is weakened.

Figure 14:
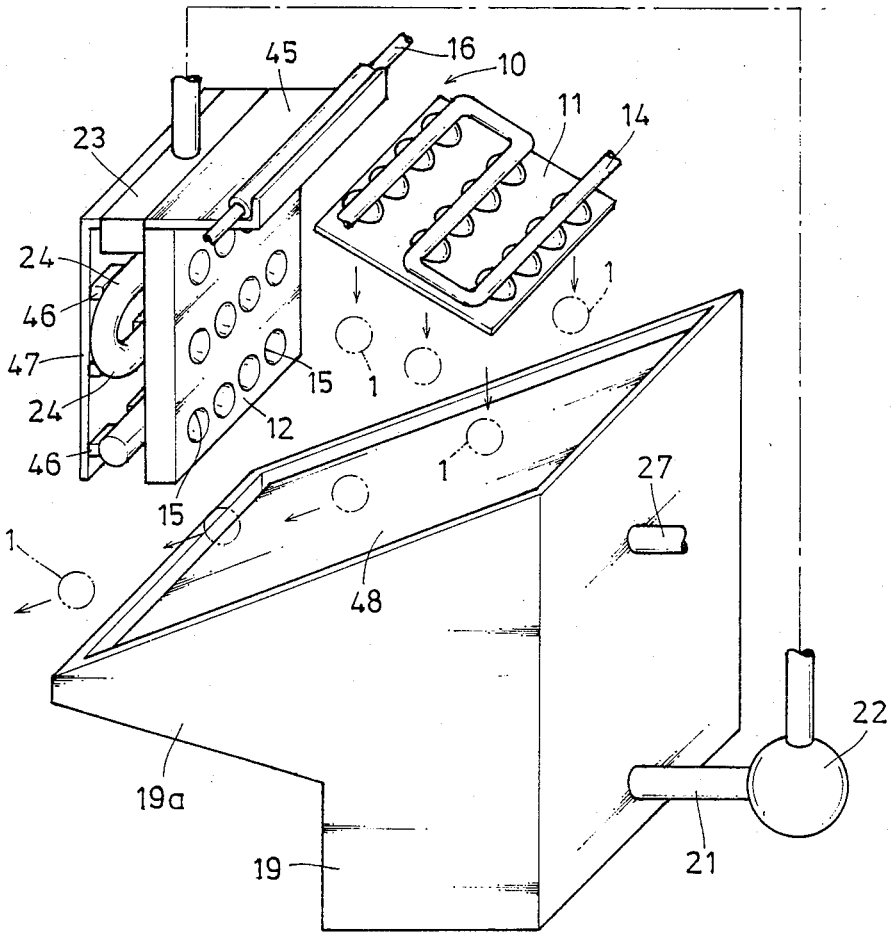

If the temperature of the second freezing chamber 12 is elevated above a predetermined level by the heating with the heater H, the temperature detecting thermostat $Th_3$ detects this temperature rise to switch the a-b contact to a-c contact, whereby the relay X is deenergized to close the normally closed contact X-b and the operation of the compressor CM is resumed, while the power supply to the heater H is stopped. Further, power is supplied to the actuator motor AM through the terminal m of the actuator motor AM for the tilting, its cam lever 17 is turned so that the cam surface **17*b* formed at the hinge portion may forcingly presses downwardly the top of the lateral walls of the second freezing chamber 12 by driving the motor AM. As already described, since the freezing of the ice balls onto the second freezing cells 15 has already been moderated, the second freezing chamber 12 can be separated forcedly off the first freezing chamber 11 to start tilting clockwise. The second freezing chamber 12 is finally opened completely in a hanging state as shown in FIG. 14**.

At this time, the ice balls 1 are still frozen to the first freezing cells 13 of the first freezing chamber 11. Just when this second freezing chamber 12 is tilted to the maximum extent, the above lever piece 37 presses the change-over switch $S_2$, so that the a-b contact is switched over to a-c contact. Thus, the water supply valve WV is opened and a fresh water to be frozen is supplied to the water tank 19, while the hot gas valve HV is opened to bypass the heated refregerant discharged from the compressor CM toward the evaporator 14. Consequently, the first freezing chamber 11 is heated and the frozen interface between the internal surface of the first freezing cells 13 and the ice balls starts to melt. Since the ice removal detecting thermostat $Th_2$ retains its open posture, a command for resuming the operation of the actuator motor AM has not yet been issued.

When the first freezing cells 13 are heated by the hot gas circulating through the evaporator 14, the frozen interface between the freezing cells and the ice balls is melted, and the ice balls drop due to their own weight to slide down along the second water guide plate 48 provided immediately below the first freezing chamber 1 to be guided and collected into the ice reservoir (not shown).

As described above, after all of the ice balls are separated from the first freezing cells 13, the temperature of the first freezing chamber 11 suddenly rises by the heat of the hot gas circulating through the evaporator 14. When this temperature rise is detected by the above ice removal detecting thermostat $Th_2$, the thermostat $Th_2$ is closed to supply power to the terminal n for the returning operation of the actuator motor AM. As a result, the motor AM is reversed to drive the cam lever 17, and the second freezing chamber 12 is urged for turning counterclockwise by means of the coil spring 18 resiliently engaged between the lever 17 and the second freezing chamber 12 to return the chamber 12 to resume its inclined posture, so that the first freezing cells 13 of the first freezing chamber 11 can be closed from downside.

The cam lever 17 is also turned counterclockwise by the reverse rotation of the motor AM to press and actuate the change-over switch $S_2$ to switch from the a-c contact to a-b contact, whereby the water supply valve WV and the hot gas valve HV are closed to stop the supply of the water to be frozen and the hot gas, respectively. Then the machine is reset to its initial state to resume the freezing operation and repeat the above-described operations. When the freezing operation and the ice removing operation are repeated alternatively, and a predetermined amount of ice balls are stored within the ice reservoir, the switch $S_1$ for detecting the stored ice is opened and to stop the operation of the machine.

Freezing Mechanism According to the Third Embodiment

Figure 16:
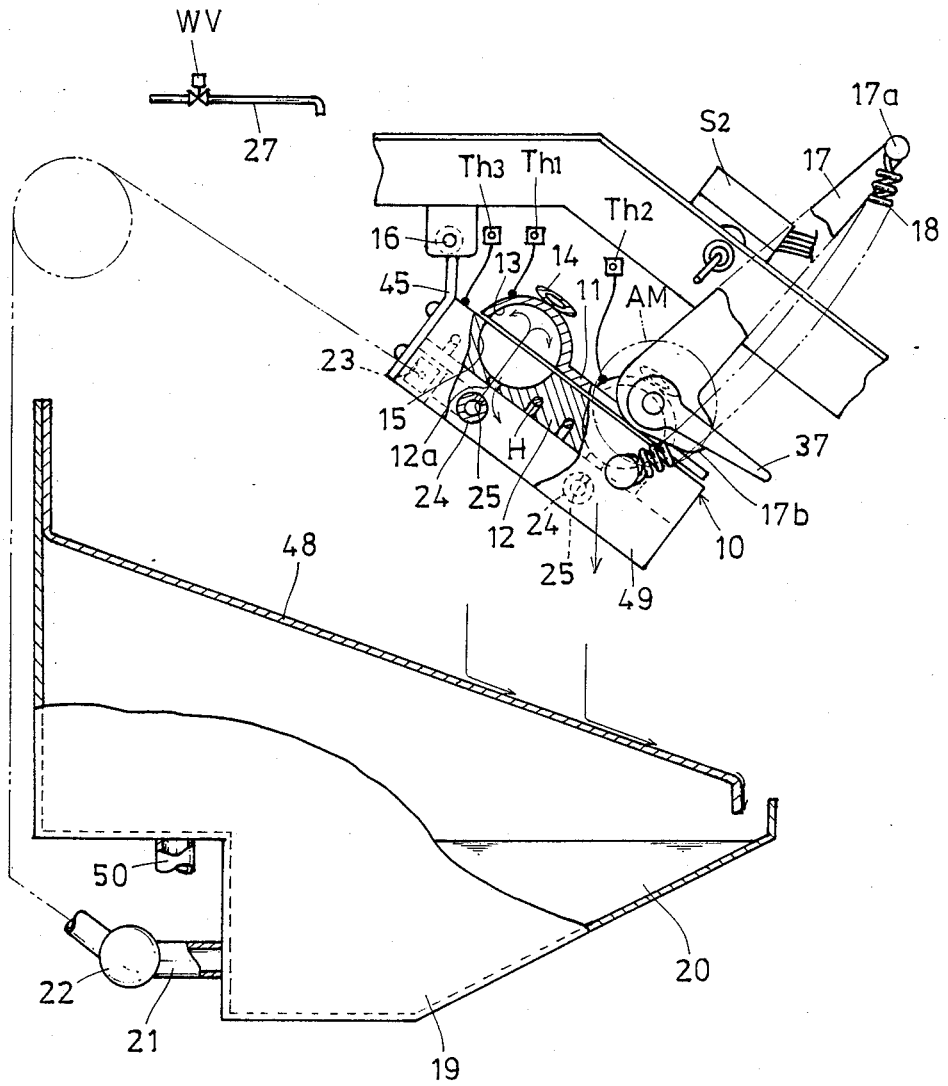
FIGS. 16 to 18 each show a third embodiment of this invention.

FIG. 16 schematically illustrates an automatic ice making machine according to the third embodiment of the invention, which is under ice-making operation. The basic constitution of the mechanism illustrated in this embodiment is almost the same as that of the previously described second embodiment. However, a mechanism is employed, in which the second freezing chamber 12 is turned with a greater angle than in the second embodiment, while the ice balls are first separated from the first freezing chamber 11 and then separated and drop from the second freezing chamber 12.

That is, the first freezing chamber 11 is fixed at an internal upper position of the housing of the machine, tilted at a predetermined angle relative to the horizontal line. On the lower surface of the first freezing chamber 11, a multiplicity of first freezing cells 13 in the form of semispherical recesses are arranged in a predetermined pattern in such a way that they may open downwardly, and an evaporator 14, an ice formation detecting thermostat $Th_1$ and an ice removal detecting thermostat $Th_2$ are closely fixed at predetermined positions of the upper surface of the first freezing chamber 11.

Immediately below the first freezing chamber 11 a second freezing chamber 12 is disposed, which closes the first freezing chamber 11 from downside during the freezing operation, while it opens the first freezing chamber 11 during the ice removing operation. On this second freezing chamber 12 a multiplicity of second freezing cells 15 are provided in the form of semispherical recesses arranged in a predetermined pattern so that they may open upwardly, each corresponding to the first freezing cells 13, and a heater H is embedded at the site proximate to each second freezing cell 15. A through hole **12*a* with a predetermined diameter is provided at the bottom of each second freezing cell 15 of the second freezing chamber 12 so that the supply of the water to be frozen from the distributor pipe 24** (to be described later) and the drainage of the unfrozen water may be achieved there through.

Figure 17:
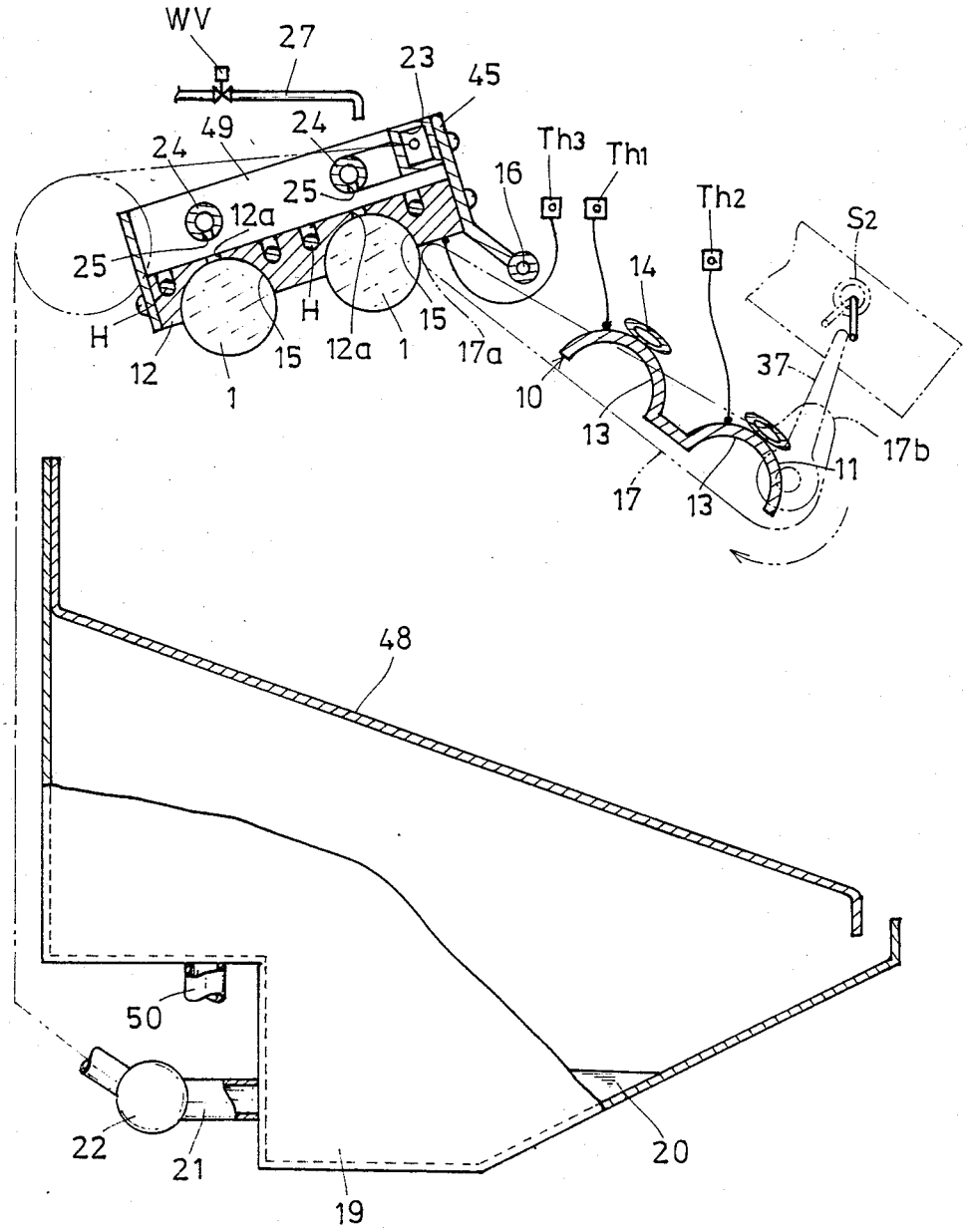
Figure 17:
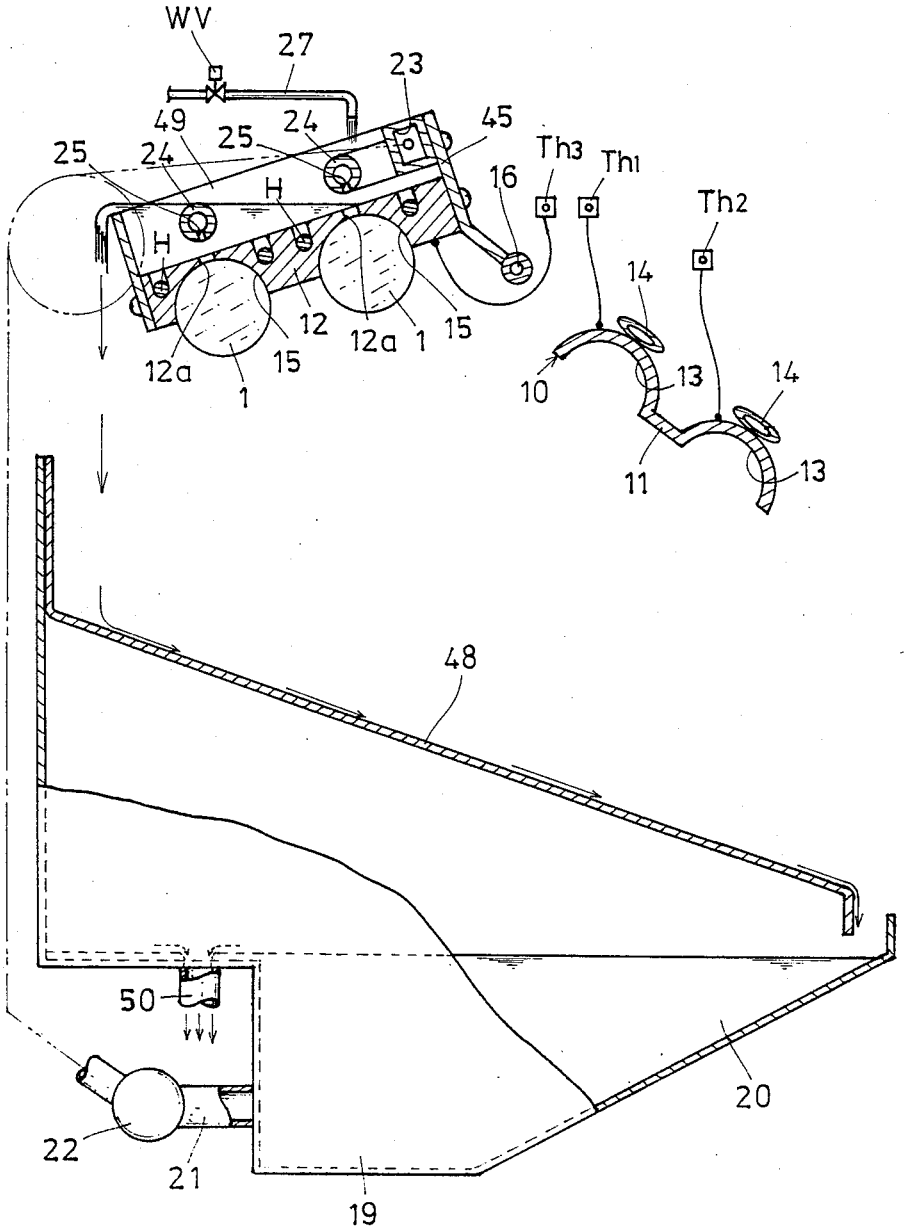
Figure 17:
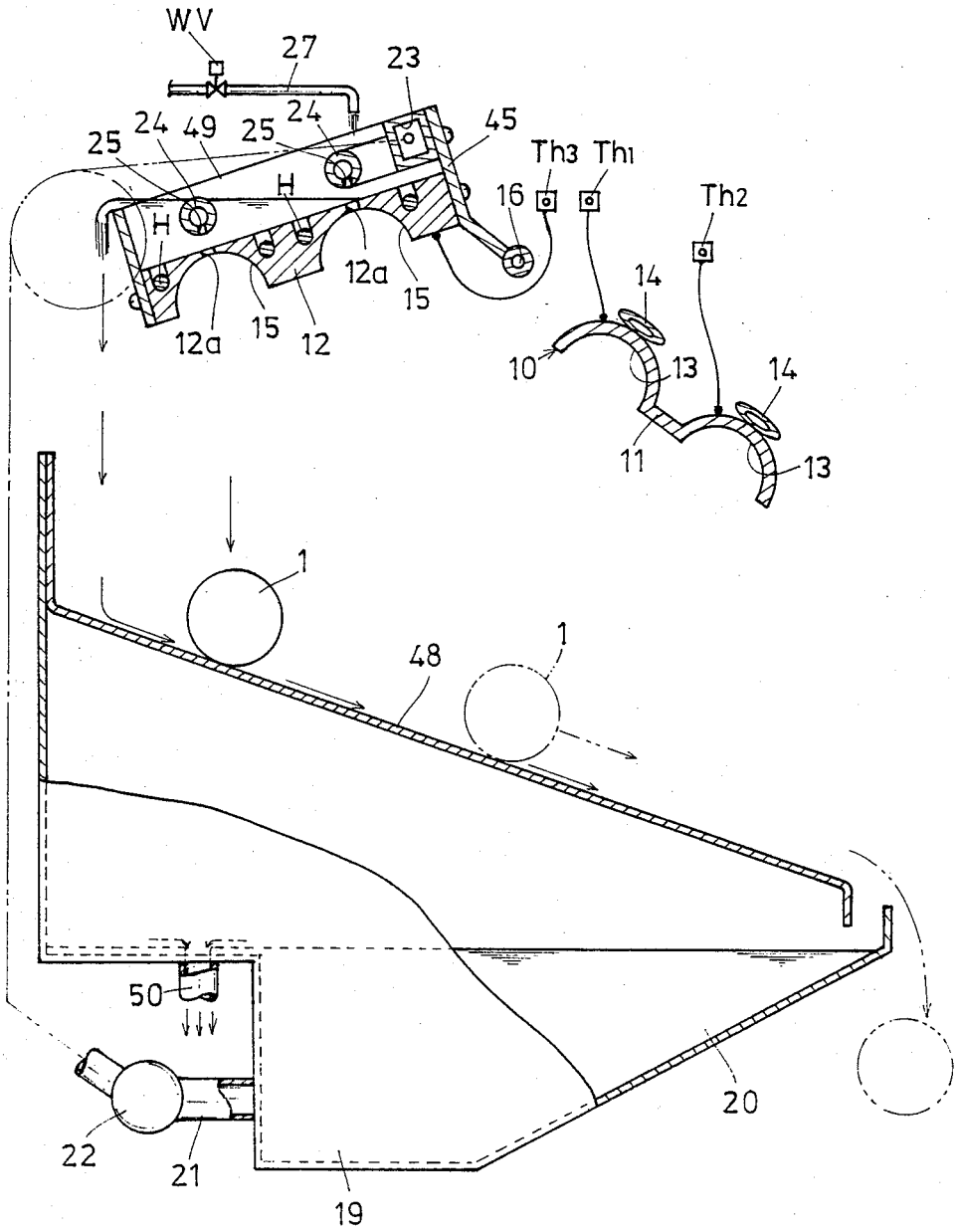
Figure 17:
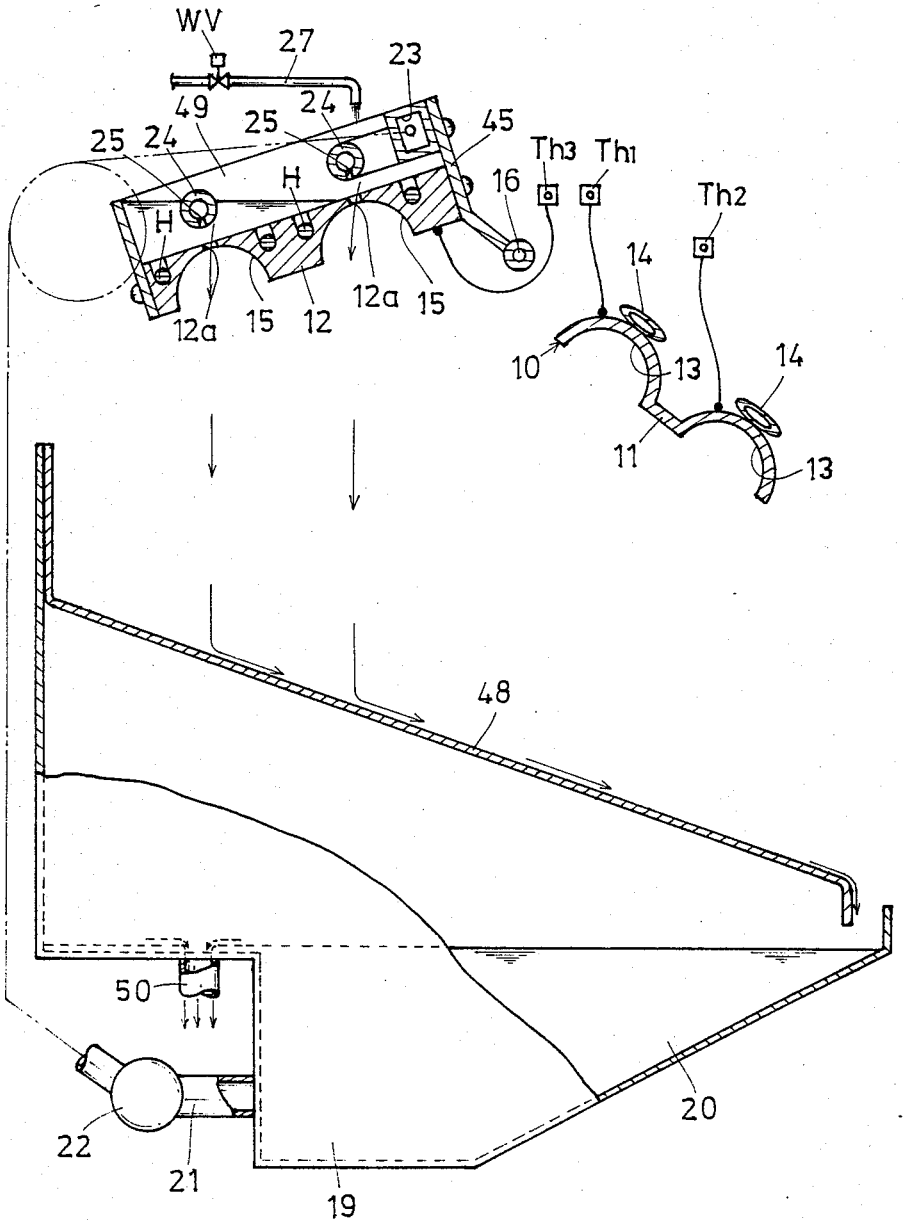

The upper end of the second freezing chamber 12 attached to the bracket 45 pivotally supported with a pivot 16 at a fixing site in the internal upper position of the housing, so that it can be tilted. The bracket 45 is adapted to turn clockwise with a larger angle on the pivot 16 under the action of the actuator motor AM to open the first freezing cells 13 in an inverted posture, as shown in FIG. 17. On the rear surface of the second freezing chamber 12, a distributor pipe 24 equipped with a pressure chamber 23 is disposed closely with a slight gap therebetween. Water injection holes 25 each corresponding to the respective second freezing cells 15 are formed in the distributor pipe 24. As shown in FIG. 16, when the second freezing chamber 12 is closed relative to the first freezing chamber 11, each of these injection holes 25 are adapted to face the correspondingly through hole **12*a* formed in the second freezing cell 15**.

Further, at each lower peripheral side edge of the rear surface of the second freezing chamber 12, a downwardly extending lateral plate 49 is fixed to form a rectangular dam. This rectangular dam made of the lateral plates 49, as shown in FIG. 17, serves to accelerate the separation of the ice balls 1 from the second freezing cells 15, by allowing the excessive water to overflow therefrom after a predetermined amount of the water supplied from the water supply pipe 27 is dammed therein when the second freezing chamber 12 is inverted with a large angle to orient the rear surface of the second freezing chamber 12 in an upwardly tilted posture.

Also in this apparatus according to the third embodiment, the water tank 19 is disposed to be separated from the second freezing chamber 12. That is, the water tank 19 is provided at a lower part of the machine housing and a water guide plate 48 is disposed to extend from the body of the tank in an upwardly tilted posture. The water guide plate 48 is located above the upper end of the tank 19, with its lower edge being bent downwardly, and the unfrozen water is guided along this bent edge into the tank 19, while the ice balls may slide down along this second ice guide plate 48 during the ice removing operation to be collected into the ice reservoir. Therefore, in the mechanism according to this third embodiment, unlike the second embodiment, the first water guide plate in the second embodiment is not provided, but the unfrozen water, which drops through the through holes **12*a* of the second freezing cells 15 during the freezing operation is adapted to pour directly onto the water guide plate 48**.

The water supply pipe 21 led out of the water tank 19 communicates via the water supply pump 22 with the pressure chamber 23, while the supply of water into the tank 19 is achieved by opening the water supply valve WV through a water supply pipe 27 connected to an external water supply system. At a predetermined site of the second freezing chamber 12 a temperature detecting thermostat $Th_3$ is disposed, so that the temperature of the second freezing chamber 12 may be monitored.

Electrical Control Circuit

Figure 18:
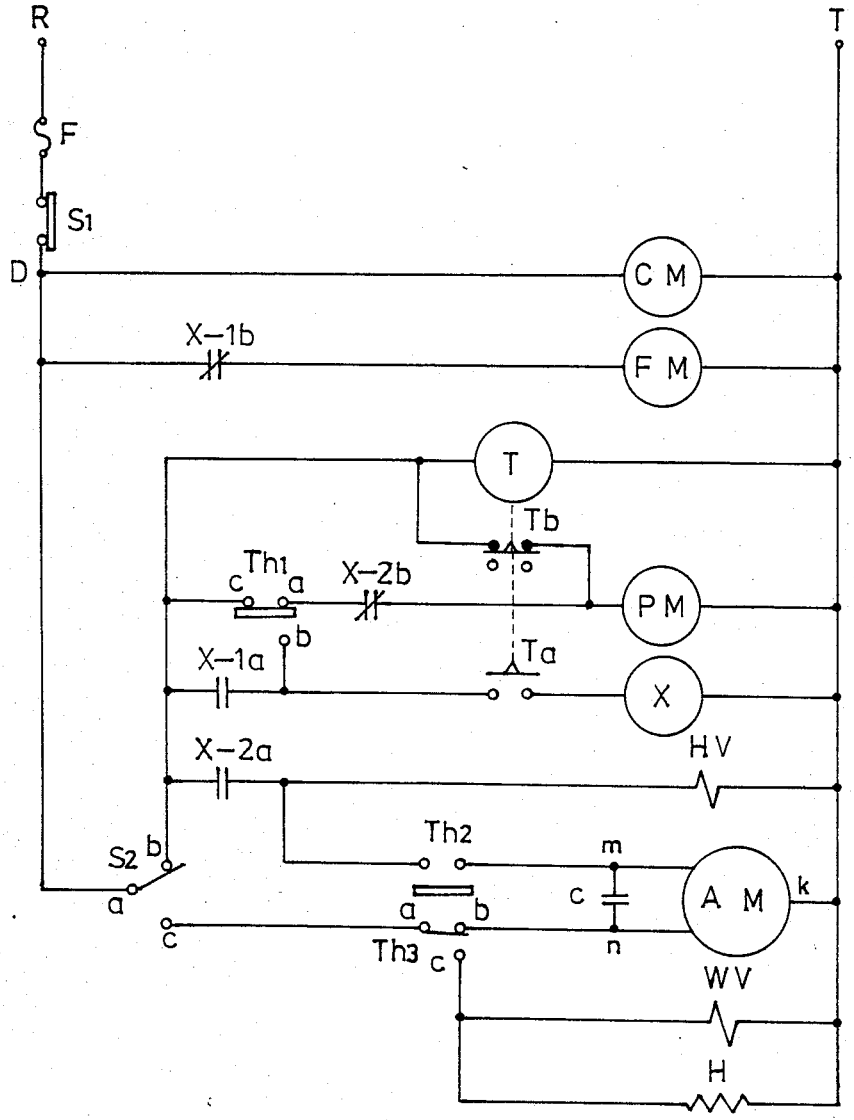

FIG. 18 shows an example of a control circuit for actuating the apparatus illustrated in the third embodiment, wherein a fuse F and a switch $S_1$ for detecting the stored ice balls, which are connected in series are provided between the power supply line R and the connecting point D, and between this connecting point D and the power supply line T, a single compressor CM and a fan motor FM are connected in parallel with a normally closed contact X-1*b* for the relay X. During the ice removing operation, the terminal a of the change-over switch $S_2$ to be actuated by the tilting of the second freezing chamber 12 is connected to the connecting point D, and the change-over contact b of the change-over switch $S_2$ connectes the following elements in parallel with the power supply line T.

(1) timer T (2) a series system comprising the contacts c and a of the ice formation detecting thermostat $Th_1$, a normally closed contact X-2*b* for the relay X and the pump motor PM. Incidentally, a nomally closed contact Tb for the timer T is interposed between the change-over contact b for the change-over switch $S_2$ and the pump motor PM.

(3) a series system comprising a normally open contact X-1*a* for the relay X, contact b for the ice formation detecting thermostat $Th_1$, a normally open contact Ta for the timer T and the relay X.

(4) series system comprising a normally open contact X-2*a* for the relay X and the hot gas valve HV. Between the normally open contact X-2*a* for the relay X and the tilting drive terminal m for the actuator motor AM, an ice removal detecting thermostat $Th_2$ is interposed, and a terminal k for the motor AM is connected to the line T.

Furthermore, the change-over contact c for the change-over switch $S_2$ is connected to the return drive terminal n of the motor AM through a-b contact of the temperature detecting thermostat $Th_3$. Between the contact c for the temperature detecting thermostat $Th_3$ and the line T, the water supply valve WV and the heater H are connected in parallel. The above-described timer T starts to integrate a prest time limit as soon as the freezing operation is started, and when the time limit is over, it is designed to open its normally closed contact Tb and close the normally open contact Ta as well.

Operation of the Third Embodiment

Next, the operation of the ice making machine according to the third embodiment is described. When power is turned on in the automatic ice making machine, the switch $S_1$ for detecting the stored ice balls is closed and the change-over switch $S_2$ is connected under a-b contact. Since the temperature of the first freezing chamber 11 is maintained approximately to room temperature, the ice formation detecting thermostat $Th_1$ is connected under c-a contact. The ice removal detecting thermostat $Th_2$ is adapted to be closed and opened when the temperature of the first freezing chamber 11 is respectively above and below a predetermined level, while it is closed during the process of the freezing operation. In the temperature detecting thermostat $Th_3$, the contacts a-c may be closed when the temperature of the second freezing chamber 12 is below a predetermined level, and the contacts a-b may be closed when it is above a predetermined level, while the contacts a-b are closed and the contacts a-c are opened during the process of the freezing operation.

Consequently, upon application of the power supply, the power supply to the compressor CM, fan motor FM and the pump motor PM is started and freezing operation is in turn started for cooling the first freezing chamber 11. The water to be frozen 20 from the water tank 19 is fed under pressure to the distributor pipe 24 by means of pump and injected via the through holes 12*a* formed in each water injection holes 25 and the second freezing chamber 12 into respective corresponding second freezing cell 15. The above timer T starts to integrate a predetermined time limit as soon as the freezing operation is started.

The injected water to be frozen is cooled down as it is brought into contact with the internal surface of the first freezing cells 13, and after the second freezing cell 15 in the second freezing chamber 12 disposed below the first freezing chamber 11 is filled therewith, the water drops via the through holes 12*a* formed at the bottom of the second freezing cells 15 to be fed back along the second water guide plate 48 to the water tank 19 for recirculation. As the circulation of the water to be frozen is repeated, the temperature of the entire water stored within the tank 19 is gradually lowered. Since a certain part of the second freezing chambers 12 is in contact with the first freezing chamber 11 and the cooled unfrozen water is circulated being in contact with the second freezing cells 15, the temperature of the second freezing chamber 12 itself will also gradually be lowered below the freezing point. Then, part of the water is frozen into an ice layer over the internal wall surface of the first freezing cells 13. As the unfrozen water is fed back repeatingly to the water tank 19 in cycles via the through holes 12*a* also serving as the water recovery holes, the growth of the ice layer further proceeds until ice balls are gradually formed finally within the spherical spaces defined by the first freezing cells 13 and the second freezing cells 15.

As soon as the time limit set by the timer T is over to open its normally closed contact Tb, the normally open contact Ta is closed. Then, as described above, when the freezing in the first and second freezing cells 13 and 15 proceeds until the temperature of the first freezing chamber 11 drops to a predetermined range, the ice formation detecting thermostat $Th_1$ upon detection of this temperature drop is switched from the c-a contact to c-b contact to stop the power supply to the pump motor PM. The relay X is excited via the closed normally open contact Ta and its normally closed contact X-1*b* is opened so that the power supply to the fan motor FM may be stopped. Upon closure of the normally open contact X-1*a*, the relay X is self-held, while the hot gas valve HV is opened upon closure of the normally open contact X-2*a*, so that the hot refrigerant discharged from the compressor CM may be bypassed to the evaporator 14. As a result, the first freezing chamber 11 is heated and the frozen interface between the internal surface of the first freezing cells 13 and the ice balls starts to melt, thereby to lower the binding force between the ice balls 1 and the first freezing cells 13.

The ice removal detecting thermostat $Th_2$ then detects the temperature rise in the first freezing chamber 11 to close its contact. The power supply may be achieved to the tilting drive terminal m of the actuator motor AM to turn the cam lever 17, so that the cam surface 17*b* formed at the hinge portion may forcedly press downwardly the top surface of the lateral wall of the second freezing chamber 12. As already described, since freezing of the ice balls to the first freezing cells 13 has been moderated, the second freezing chamber 12 is forcedly separated from the first freezing chamber 11 to start clockwise tilting. With the ice balls 1 frozen to the second freezing cells 15, the second freezing chamber 12, as shown in FIG. 17, is turned to the substantially inverted state until its rear surface may face upward in a tilted posture. At this time, the lower half of the ice ball 1 exposed from the second freezing cell 15 locates above the water guide plate 48 of the water tank 19.

Just when the inverted posture of the second freezing chamber 12 has reached the maximum angle, the lever piece 37 presses the change-over switch $S_2$ to switch its a-b contact to a-c contact. Thus, the driving of the actuator motor AM is stopped, while the relay X is deenergized to open the normally open contact X-1*a* so that the self-holding of the relay X may be released. Further, the normally closed contact X-1*b* is closed and the power supply to the fan motor FM is started, while the normally open contact X-2*a* is opened to close the hot gas valve HV, whereby the supply of the refrigerant into the evaporator 14 is resumed to start cooling of the first freezing chamber 11.

Since the ice balls 1 are still frozen to the second freezing chamber 12, the temperature detecting thermostat $Th_3$ remains switched to a-c contact. Therefore, upon switching of the change-over switch $S_2$ from the a-b contact to a-c contact, the water supply valve WV is opened and the normal temperature external tap water is supplied through the water supply pipe 27 to the rear surface of the second freezing chamber 12. Since the rectangular dam consists of the lateral plates 49 is formed, as described above, on the rear surface of this second freezing chamber 12, the above external tap water of normal temperature is stored within this dam in a predetermined quantity to elevate the temperature of the second freezing chamber 12, while the excessive water overflows to be guided along the water guide plate 48 to be recovered into the water tank 19. The level of the water introduced into the tank 19 rises, and when it reaches a predetermined level, it is drained to the outside of the machine through the overflow pipe 50. Upon opening of the water supply valve WV, the power supply to the heater H is also achieved and the second freezing chamber 12 is positively heated to moderate the freezing between the second freezing cells 15 and the ice balls 1, whereby the ice balls drop due to its own weight to slide down along the water guide plate 48 provided immediately therebelow to be collected into the ice reservoir (not shown).

As described above, when all of the ice balls are separated from the second freezing cells 15, the temperature of the second freezing chamber 12 gradually rises under the action of the external tap water fed continuously from the water supply pipe 27. When the ice blocking the through holes 12*a* formed in each second freezing cell 15 is melted, the melted tap water drops through this through holes 12*a* and is guided along the water guide plate 48 into the water tank 19. The temperature rise in the second freezing chamber 12 is detected by the temperature thermostat $Th_3$ to switch a-c contact to a-b contact. Thus, the water supply valve WV is closed and the power supply to the heater H is stopped, while power supply to the return drive terminal n in the actuator motor AM is achieved. Consequently, the motor AM is reversed to drive the cam lever 17 for urging the second freezing chamber 12 to turn counterclockwise with the aid of the coil spring 18 resiliently engaged between the lever 17 and the second freezing chamber 12 to return it in the tilted posture, so that the first freezing cells 13 of the first freezing chamber 11 may be closed from downside.

The reverse rotation of the motor AM causes the cam lever 17 to turn and press the change-over switch $S_2$, whereby the a-c contact is switched over to a-b contact for resuming the freezing operation. Incidentally, during the previous ice removing operation, during the time starting from the point when the change-over switch $S_2$ is switched over from the a-b contact to a-c contact to the point when said switch $S_2$ is switched back again to a-b contact, the first freezing chamber 11 is cooled under an unloaded condition, and its temperature is lowered to the temperature at which the freezing operation may be completed. Consequently, the ice formation detecting thermostat $Th_1$ has already been switched over from c-a contact to c-b contact. If the change-over switch $S_2$ is switched over from a-c contact to a-b contact in this state, since the ice formation detecting thermostat $Th_1$ has detected completion of the freezing operation, the machine runs into the ice removing operation again and then enters into a hunting condition in which cooling and heating cycles are repeated in the first freezing chamber 11.

Therefore, in this embodiment, the timer T is adapted to start time integration of a predetermined time limit as soon as the freezing operation is started and not to accept any signals from the ice formation detecting thermostat $Th_1$ unless the time limit set in the timer T is over. That is, when the switch $S_2$ is switched over to a-b contact, since the ice formation detecting thermostat $Th_1$ has already been switched to c-b contact but the normally open contact Ta of the timer T is open, power supply to the relay X is not achieved. As a result, the normally open contact X-2*b* for the relay X retains its open posture, and the normally closed contact X-1*b* and the normally closed contact X-2*b* each retain their closed posture, so that the cooling in the first freezing chamber 11 is continued. Since the normally closed contact Tb of the timer T is closed, power supply to the pump motor PM is achieved and the water to be frozen within the water tank 19, which has been warmed, is injected through each injection hole 25 in the distributor pipe 24 and the through hole 12*a* formed in the second freezing chamber 12 into the corresponding second freezing cell 15, respectively. This warm water is rapidly cooled down being in contact with the first freezing chamber 11 to be excessively cooled down to the temperature at which the freezing operation may be completed, causing temperature rise in the first freezing chamber 11, as the result of heat exchange. When the temperature of the first freezing chamber 11 reaches above the freezing completion temperature, the ice formation detecting thermostat $Th_1$ is switched over form c-b contact to c-a contact, so that power supply to the pump motor PM is also achieved from this system.

After a while, the time limit set in the timer T is over and its normally open contact Ta is closed, while the normally closed contact Tb is opened. Consequently, power is supplied to the pump motor PM only through the c-a contact of the thermostat $Th_1$. When a predetermined amount of ice balls are stored within the ice reservoir after the above freezing and ice removing operations are repeated alternatively for cycles, the switch $S_1$ for detecting the stored ice balls is opened to stop operation of the machine.

What is claimed is:

1. An automatic ice making machine having a constitution in which a water to be frozen stored within a water tank is fed under pressure to a distributor pipe via a pump and injected through injection holes formed along said distributor pipe into an ice making chamber cooled by an evaporator connected to a freezing system, to form ice cakes within said ice making chamber, while a part of the freezing water which is not frozen within said ice making chamber is fed back to said water tank for recirculation, characterized in that said ice making chamber consists of a first freezing chamber having formed thereon a multiplicity of downwardly opening first freezing cells of a predetermined recessed shape, with said evaporator disposed on its rear surface; and a second freezing chamber having formed thereon a multiplicity of upwardly opening second freezing cells of said predetermined recessed shape, said second freezing cells being disposed subjacent to and movable relative to said first freezing chamber to define ice forming spaces between said first and second freezing cells during the freezing operation.

2. An automatic ice making machine according to claim 1, wherein said first freezing cells are closed with the corresponding second freezing cells to define spherical ice forming spaces therebetween.

3. An automatic ice making machine according to claim 1, wherein said first freezing cells are closed with the corresponding second freezing cells to define polyhedral ice forming spaces therebetween.

4. An automatic ice making machine according to claim 1, wherein said first freezing chamber is disposed within the body of said machine to be fixed therein substantially horizontally, and said second freezing chamber is pivotally supported such that it can be tilted or spaced relative to said first freezing chamber.

5. An automatic ice making machine according to claim 1, wherein said first freezing chamber is disposed within the body of said machine to be fixed therein in a tilted posture, and said second freezing chamber is pivotally supported such that it can be tilted or spaced relative to said first freezing chamber and that it can be suspended substantially perpendicularly when it is spaced from said first freezing chamber with the maximum degree.

6. An automatic ice making machine according to claim 1, wherein said first freezing chamber is disposed within the body of said machine to be fixed therein in a tilted posture, and said second freezing chamber is pivotally supported such that it can be tilted or spaced relative to said first freezing chamber and that it can spring up to a level where the second freezing cells in said second freezing chamber may face downward, when they are spaced from each other with the maximum degree.

7. An automatic ice making machine having a constitution in which a water to be frozen stored within a water tank is fed under pressure to a distributor pipe via a pump and injected through injection holes formed along said distributor pipe into a freezing chamber cooled by an evaporator connected to a freezing system, to form ice cakes within said freezing chamber, while a part of the freezing water which is not frozen within said freezing chamber is fed back to said water tank for recirculation, comprising:

a first freezing chamber having formed thereon a multiplicity of downwardly opening first freezing cells of a predetermined recessed shape, with said evaporator disposed on its rear surface;

a second freezing chamber having formed thereon a multiplicity of upwardly opening second freezing cells of said predetermined recessed shape, said second freezing chamber being disposed subjacent to and movable relative to said first freezing chamber between said first and second freezing cells during the freezing operation; and an ice guide means which is pivotally supported at a portion below said second freezing chamber to block usually the locus along which the ice cakes drop, and, when said second freezing chamber is tilted off from said first freezing chamber during the ice removing operation, urged to fall over the upper surface of said second freezing chamber to guide the ice cakes dropping said first freezing chamber into an ice reservoir.

8. An automatic ice making machine having a constitution in which a water to be frozen stored within a water tank is fed under pressure to a distributor pipe via a pump and injected through injection holes formed along said distributor pipe into a freezing chamber cooled by an evaporator connected to a freezing system, to form ice cakes within said freezing chamber, while a part of the freezing water which is not frozen within said freezing chamber is fed back to said water tank for recirculation, comprising:

a first freezing chamber having formed thereon a multiplicity of downwardly opening first freezing cells of a predetermined recessed shape, with said evaporator disposed on its rear surface;

a second freezing chamber having formed thereon a multiplicity of second freezing cells of a predetermined recessed shape, which is disposed relative to said first freezing chamber such that the former may be moved closer to or spaced for latter, wherein said second freezing cells close the corresponding first freezing cells from downside, respectively, to define ice forming spaces of a spherical or polyhedral shape therebetween during the freezing operation; and an ice guide means which is pivotally supported at a portion below said second freezing chamber to block usually the locus along which the ice cakes drop, and, when said second freezing chamber is tilted off from said first freezing chamber during the ice removing operation, urged to fall over the upper surface of said second freezing chamber to guide the ice cakes dropping said first freezing chamber into an ice reservoir, said ice guide means being provided on a shaft which is pivotally supported obliquely below said second freezing chamber and above the ice reservoir such that said means may be urged by a member which can be titled integrally with said second freezing chamber, to fall over the upper surface of said second freezing chamber when said second freezing chamber is tiltingly spaced apart from said first freezing chamber during the ice removing operation, while said means may be spaced apart from the upper surface of said second freezing chamber interlocking with the action of said second freezing chamber to approach said first freezing chamber to resume its initial posture.

* * * * *